US010914328B2

(12) United States Patent
Ogawa et al.

(10) Patent No.: US 10,914,328 B2
(45) Date of Patent: Feb. 9, 2021

(54) WORK MACHINE

(71) Applicant: Hitachi Construction Machinery Co., Ltd., Tokyo (JP)

(72) Inventors: Yuichi Ogawa, Tsuchiura (JP); Shinya Imura, Toride (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 16/492,433

(22) PCT Filed: Dec. 26, 2017

(86) PCT No.: PCT/JP2017/046802
§ 371 (c)(1),
(2) Date: Sep. 9, 2019

(87) PCT Pub. No.: WO2019/130451
PCT Pub. Date: Jul. 4, 2019

(65) Prior Publication Data

US 2020/0040547 A1 Feb. 6, 2020

(51) Int. Cl.
*F15B 21/14* (2006.01)
*E02F 9/22* (2006.01)
(Continued)

(52) U.S. Cl.
CPC ..... *F15B 21/14* (2013.01); *E02F 3/32* (2013.01); *E02F 3/425* (2013.01); *E02F 3/43* (2013.01);
(Continued)

(58) Field of Classification Search
None
See application file for complete search history.

(56) References Cited

U.S. PATENT DOCUMENTS 9,574,329 B2 * 2/2017 Wu ..... E02F 9/2264
10,167,611 B2 * 1/2019 Kondo ..... F15B 11/028
(Continued)

FOREIGN PATENT DOCUMENTS

EP 2 636 910 A1 9/2013
JP 4-185903 A 7/1992
(Continued)

OTHER PUBLICATIONS

International Search Report (PCT/ISA/210) issued in PCT Application No. PCT/JP2017/046802 dated Jan. 30, 2018 with English translation (five (5) pages).
(Continued)

*Primary Examiner* — Abiy Teka
*Assistant Examiner* — Michael Quandt
(74) *Attorney, Agent, or Firm* — Crowell & Moring LLP

(57) ABSTRACT

It is made possible to suppress variations of the speed of an actuator into which a regeneration flow rate flows, regardless of variations of the regeneration flow rate caused by posture changes of the front part and to enhance the operability when the front part moves in the free fall direction, and hydraulic fluid discharged from an actuator driving the front part is regenerated. Accordingly, a controller 19 of a hydraulic system is provided with a regeneration control calculation section 19*b*, and a pump flow rate control calculation section 19*c*, and when the regeneration control calculation section controls a regeneration valve 12 to perform regeneration, the pump flow rate control calculation section controls a pump flow rate regulation device 20 to increase the delivery flow rate of a hydraulic pump 1 as the angle of an arm 16 approaches the vertically downward direction based on posture information about the arm 16 acquired by an inertial measurement unit 31.

14 Claims, 29 Drawing Sheets

(51) Int. Cl.

| | |
|---|---|
| ***F15B 11/024*** | (2006.01) |
| ***F15B 13/07*** | (2006.01) |
| ***E02F 3/32*** | (2006.01) |
| ***E02F 3/42*** | (2006.01) |
| ***E02F 3/43*** | (2006.01) |
| ***E02F 9/26*** | (2006.01) |

(52) U.S. Cl.

CPC ..... *E02F 9/2217* (2013.01); *E02F 9/2235* (2013.01); *E02F 9/2296* (2013.01); *E02F 9/265* (2013.01); *F15B 11/024* (2013.01); *F15B 13/07* (2013.01); *F15B 2011/0243* (2013.01); *F15B 2211/20546* (2013.01); *F15B 2211/7053* (2013.01); *F15B 2211/761* (2013.01); *F15B 2211/88* (2013.01)

(56) References Cited

U.S. PATENT DOCUMENTS

| | | | | |
|---|---|---|---|---|
| 2004/0055289 | A1 | 3/2004 | Pfaff et al. | |
| 2018/0238025 | A1* | 8/2018 | Imura ..... | E02F 9/2296 |

FOREIGN PATENT DOCUMENTS

| | | | |
|---|---|---|---|
| JP | 8-219121 | A | 8/1996 |
| JP | 11-101202 | A | 4/1999 |
| JP | 11-311205 | A | 11/1999 |
| JP | 2004-270924 | A | 9/2004 |
| JP | 2008-128464 | A | 6/2008 |
| JP | 2010-286074 | A | 12/2010 |
| JP | 2011-220356 | A | 11/2011 |
| JP | 2012-237339 | A | 12/2012 |

OTHER PUBLICATIONS

Japanese-language Written Opinion (PCT/ISA/237) issued in PCT Application No. PCT/JP2017/046802 dated Jan. 30, 2018 (four (4) pages).

International Preliminary Report on Patentability (PCT/IB/338 & PCT/IB/373) issued in PCT Application No. PCT/JP2017/046802 dated Jul. 9, 2020, including English translation of document C2 (Japanese-language Written Opinion (PCT/ISA/237) previously filed on Sep. 9, 2019) (seven pages).

Korean-language Office Action issued in Korean Application No. 10-2019-7025820 dated Nov. 2, 2020 with English translation (12 pages).

* cited by examiner

PUMP DISCHARGE PRESSURE AND ARM CYLINDER BOTTOM PERSSURE WHEN PUMP FLOW RATE IS REDUCED IN CASE HEABY BUCKET IS USED $$\theta_{Arm} = \theta_{body} + \theta_B - \theta_A \quad \cdots \quad \text{FORMULA (1)}$$

WORK MACHINE

TECHNICAL FIELD

The present invention relates to a work machine including a hydraulic system, and in particular relates to a work machine such as a hydraulic excavator that includes a hydraulic actuator and a hydraulic pump, and includes, in the hydraulic system, a regenerating circuit that regenerates hydraulic fluid energy of the hydraulic actuator.

BACKGROUND ART

Generally, work machines such as hydraulic excavators supply hydraulic fluid from a hydraulic pump in order to drive actuators of parts to be driven such as a plurality of front parts constituting a front work implement. In an attempt to lower motive power consumption of an engine as a motive power source to drive the hydraulic pump, and enhance fuel efficiency, unnecessary motive power of the hydraulic pump may be reduced. For realization of this, there are known regenerating circuits that realize enhancement of fuel efficiency by regenerating hydraulic fluid discharged from the hydraulic actuator, and simultaneously reducing the delivery flow rate of a hydraulic pump to reduce motive power of the hydraulic pump. One example of such regenerating circuits is described in Patent Document 1, for example. Patent Document 1 proposes to perform control such that, when an arm is actuated in a free fall direction, hydraulic fluid discharged from the rod-side of an arm cylinder is regenerated on the bottom-side of the arm cylinder while at the same time the delivery flow rate of a hydraulic pump is minimized, and otherwise regeneration is disabled while at the same time the delivery flow rate of the hydraulic pump is kept at a normal delivery flow rate.

PRIOR ART DOCUMENT

Patent Document

Patent Document 1: JP-2011-220356-A

SUMMARY OF THE INVENTION

Problem to be Solved by the Invention

As described in Patent Document 1, it is possible to reduce hydraulic pump output power by measuring the actuation direction of an arm. However, in case where the system described in Patent Document 1 is used, the flow rate (regeneration flow rate) of hydraulic fluid discharged from the rod-side of the arm cylinder is high when the arm is actuated in the arm crowding direction while a direction of the arm is closer to the horizontal direction, and the regeneration flow rate decreases as the direction of the arm approaches the vertical direction. Accordingly, during operation, the flow rate of hydraulic fluid to flow into the bottom-side of the arm cylinder varies largely to cause variations of the cylinder speed, and the operability might deteriorate. In addition, at the time of regeneration switching when the arm is in the vertically downward direction, and the regeneration flow rate becomes zero, the delivery flow rate of the hydraulic pump increases, the amount of hydraulic fluid to flow into the arm cylinder varies largely to cause variations of the cylinder speed, and the operability might deteriorate. Furthermore, when the delivery flow rate of the hydraulic pump is reduced in case where the tip of the front work implement is heavy, the pressure on the bottom-side of the arm cylinder becomes a negative value to cause cavitation, and it becomes impossible to control the arm cylinder at an intended speed. As a result, the operability deteriorates inevitably.

Although the system described in Patent Document 1 supplies hydraulic fluid discharged from the rod-side of the arm cylinder to the bottom-side of the arm cylinder which is the same actuator, and regenerates it, a similar problem occurs also in a hydraulic system that regenerates hydraulic fluid discharged from the rod-side of an arm cylinder in an actuator different from the arm cylinder.

The present invention is made based on the matters mentioned above, and an object thereof is to provide a work machine including a hydraulic system which makes it possible to suppress variations of the speed of an actuator into which a regeneration flow rate flows, regardless of variations of the regeneration flow rate caused by posture changes of a front part, and to enhance the operability when the front part moves in the free fall direction, and hydraulic fluid discharged from an actuator driving the front part is regenerated.

Means for Solving the Problem

In order to achieve the object explained above, the present invention provides a work machine comprising: a front work implement constituted by a plurality of front parts, each of the plurality of front parts being pivotably connected with a machine body or other front parts; and a hydraulic system including a plurality of actuators that drive the plurality of front parts, the plurality of front parts including a first front part that can move in a free fall direction, the plurality of actuators including a first actuator that is a hydraulic cylinder type that drives the first front part, the hydraulic system including: a regenerating circuit that supplies a hydraulic fluid discharged from a hydraulic fluid discharge-side of the first actuator to a hydraulic fluid supply-side of a second actuator; a regeneration control device that controls a regenerating state of the regenerating circuit; a hydraulic pump that supplies hydraulic fluid to the second actuator; and a pump flow rate regulation device that controls a delivery flow rate of the hydraulic pump, wherein the work machine further comprises: a posture information acquiring device that acquires posture information about the first front part; and a controller that controls the regeneration control device and the pump flow rate regulation device on a basis of the posture information about the first front part acquired by the posture information acquiring device, and the controller includes: a regeneration control calculation section that controls the regeneration control device to cause the regenerating circuit to perform regeneration based on the posture information about the first front part acquired by the posture information acquiring device when the first front part moves in the free fall direction; and a pump flow rate control calculation section that controls the pump flow rate regulation device to increase the delivery flow rate of the hydraulic pump successively as a direction of the first front part approaches a vertically downward direction, based on the posture information about the first front part acquired by the posture information acquiring device, when the regeneration control calculation section controls the regeneration control device to perform regeneration.

In this manner, the regeneration control calculation section, and when the regeneration control calculation section controls the regeneration control device to perform regeneration, the pump flow rate control calculation section controls the pump flow rate regulation device to increase the delivery flow rate of the hydraulic pump successively as the direction of the first front part approaches a vertically downward direction, based on the posture information about the first front part acquired by the posture information acquiring device. Thereby, when the front part moves in the free fall direction, and hydraulic fluid discharged from an actuator driving the front part is regenerated, it is possible to suppress variations of the speed of an actuator into which a regeneration flow rate flows, regardless of variations of the regeneration flow rate caused by posture changes of the front part, and to enhance the operability.

Advantages of the Invention

According to the present invention, it is possible to suppress variations of the speed of an actuator into which a regeneration flow rate flows, regardless of variations of the regeneration flow rate caused by posture changes of the front part, and to enhance the operability while at the same time cavitation is prevented, when the front part moves in the free fall direction, and hydraulic fluid discharged from an actuator driving the front part is regenerated.

MODES FOR CARRYING OUT THE INVENTION

Hereinafter, embodiments of the present invention are explained with reference to the figures.

First Embodiment

A work machine according to a first embodiment of the present invention is explained by using FIG. 1 to FIG. 13, and FIG. 29.

Figure 29:
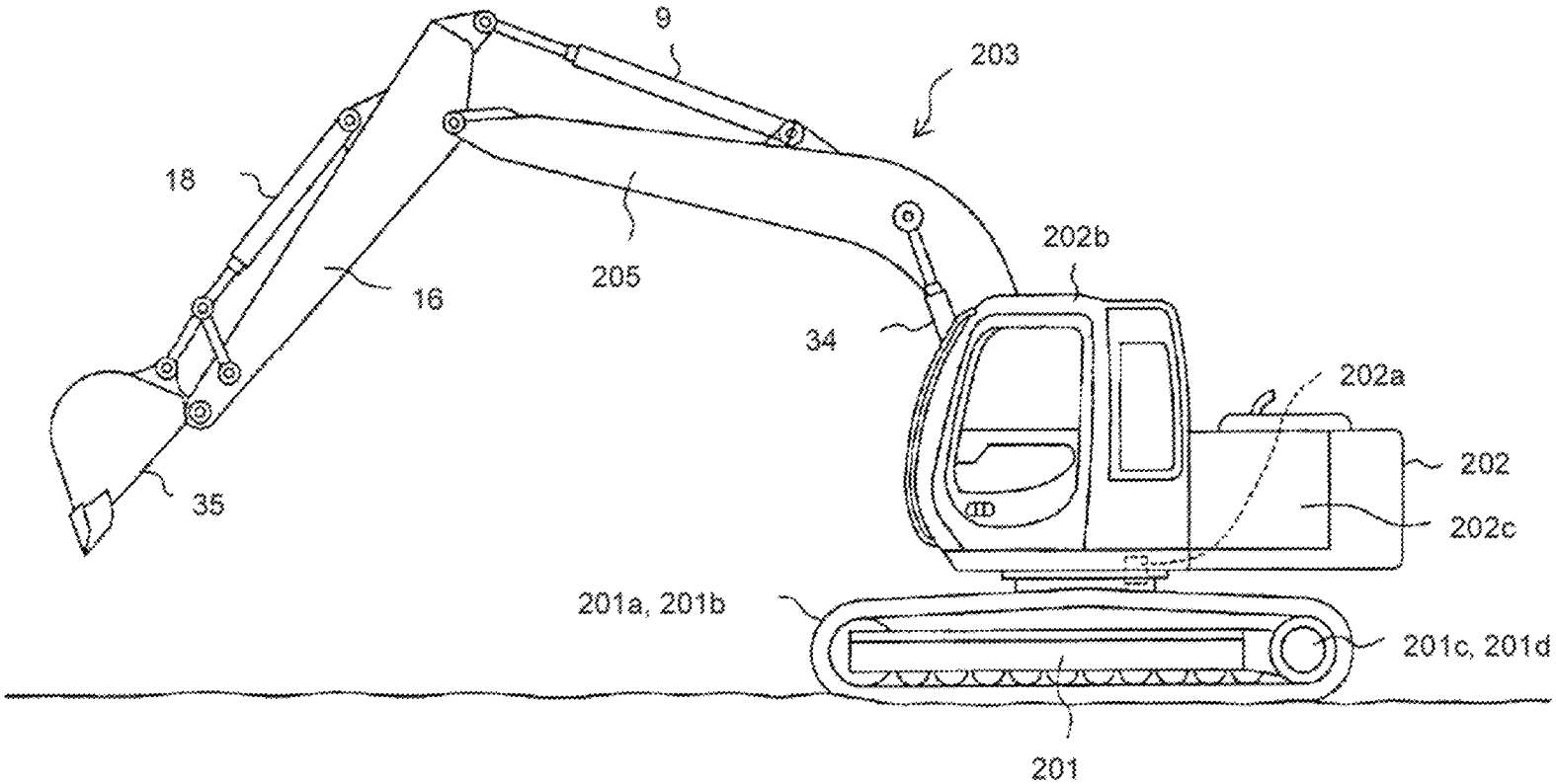
FIG. 29 is a figure illustrating the external appearance of a hydraulic excavator which is one example of work machines (construction machines).

FIG. 29 is a figure illustrating the external appearance of a hydraulic excavator which is one example of work machines (construction machines).

The hydraulic excavator includes a lower track structure 201, an upper swing structure 202, and a front work implement 203. The lower track structure 201, and upper swing structure 202 constitute the machine body. The lower track structure 201 has left and right crawler type track devices 201*a* and 201*b* (only one of them is illustrated), and the crawler type track devices 201*a* and 201*b* are driven by left and right track motors 201*c* and 201*d* (only one of them is illustrated). The upper swing structure 202 is mounted on the lower track structure 201 so as to be swingable, and is swing-driven by a swing motor 202*a*. The front work implement 203 is attached to a front portion of the upper swing structure 202 so as to be able to face up and down. The upper swing structure 202 is provided with a cabin (operation room) 202*b*. In the cabin 202*b*, an operator's seat, and operation devices such as operation lever devices for the front implement for swinging that are positioned on the left and right of the operator's seat, and operation lever/pedal devices for traveling positioned in front of the operator's seat are arranged.

The front work implement 203 has an articulated structure having a plurality of front parts including a boom 205, an arm 16, and a bucket 35. The boom 205 is connected to the upper swing structure 202 (machine body) so as to be pivotable upward/downward, the arm 16 is connected to the boom 205 so as to be pivotable upward/downward and forward/backward, and the bucket 35 is connected to the arm 16 so as to be pivotable upward/downward and forward/backward. In addition, the boom 205 pivots relative to the upper swing structure 202 along with extension and contraction of boom cylinders 34, the arm 16 pivotably moves relative to the boom 205 along with extension and contraction of an arm cylinder 9, and the bucket 35 pivotably moves relative to the arm 16 along with extension and contraction of a bucket cylinder 18.

Figure 1:
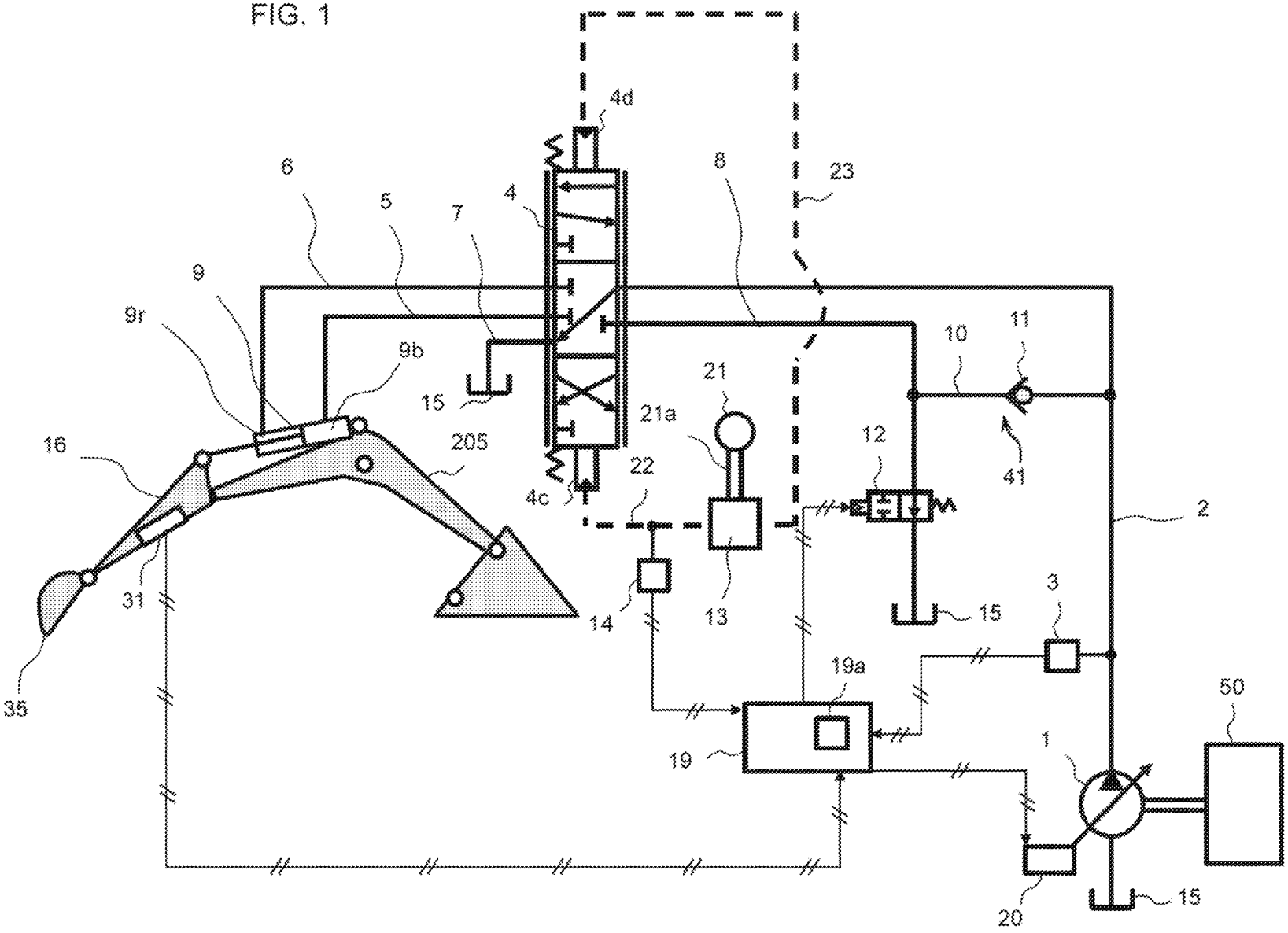
FIG. 1 is a figure illustrating a hydraulic system provided to a work machine, of a first embodiment of the present invention, the figure illustrating a case where there is no input to an operation lever.

FIG. 1 is a figure illustrating a hydraulic system provided to the work machine, of the first embodiment of the present invention. Note that FIG. 1 illustrates only a circuit portion related to the arm cylinder 9. For simplification of illustration, illustration of circuit portions related to the actuators (the boom cylinders 34, bucket cylinder 18, swing motor 202*a*, and left and right track motors 201*c* and 201*d* illustrated in FIG. 1) other than the arm cylinder 9 is omitted.

In FIG. 1, the hydraulic system in the present embodiment includes: an engine 50; a variable displacement hydraulic pump 1 driven by the engine 50; a pump flow rate regulation device 20 that controls the delivery flow rate of the hydraulic pump 1; a directional control valve 4 connected to a hydraulic fluid supply line 2 of the hydraulic pump 1; the arm cylinder 9 mentioned above that drives the arm 16; a bottom line 5 that connects the directional control valve 4 to a bottom-side chamber 9*b* of the arm cylinder 9; a rod line 6 that connects the directional control valve 4 to a rod-side chamber 9*r* of the arm cylinder 9; a center bypass line 7 that connects the directional control valve 4 to a tank 15; a tank line 8 that connects the directional control valve 4 to the tank 15; a solenoid valve-type regeneration valve 12 which is a regeneration control device arranged in the tank line 8; a regeneration line 10 that is located upstream of the regeneration valve 12 and connects the tank line 8 to the hydraulic fluid supply line 2; and a check valve 11 that is arranged in the regeneration line 10, allows hydraulic fluid to flow from the tank line 8 to the hydraulic fluid supply line 2, and prevents hydraulic fluid from flowing in the opposite direction.

An inertial measurement unit (IMU) 31 for measuring the angle of the arm 16 relative to the horizontal plane is attached to the arm 16 as a posture information acquiring device to acquire posture information about the arm 16. The inertial measurement unit 31 is a device that can measure a three-dimensional angular velocity, and acceleration, and can determine the angle of the arm 16 relative to the horizontal plane by using the information.

In addition, the hydraulic system includes an operation lever device 21 which is one of operation devices arranged in the cabin 202*b* illustrated in FIG. 29. The operation lever device 21 is constituted by an operation lever 21*a*, and a pilot valve 13 attached to a base end portion of the operation lever 21*a*. The pilot valve 13 is connected to an operation port 4*c* of the directional control valve 4 via a pilot line 22, which operation port 4*c* is for actuation in the arm crowding direction, and to an operation port 4*d* via a pilot line 23, which operation port 4*d* is for actuation in the arm dumping direction. A pressure corresponding to an operation amount of the operation lever 21*a* is guided from the pilot valve 13 to the operation port 4*c* or operation port 4*d* of the directional control valve 4.

A pressure sensor 3 for measuring the delivery pressure of the hydraulic pump 1 is attached to the hydraulic fluid supply line 2 as a pressure information acquiring device to acquire the delivery pressure of the hydraulic pump 1.

A pressure sensor 14 for detecting a pressure to be transmitted to the operation port 4*c* is attached to the pilot line 22 as an actuation direction information acquiring device to acquire an actuation direction of the arm cylinder 9 and as an operation amount information acquiring device to acquire an operation amount of the operation lever device 21 with an operation by an operator.

The pressure sensor 3, pressure sensor 14, and inertial measurement unit 31 are electrically connected to a controller 19, and the controller 19 is electrically connected to the pump flow rate regulation device 20, and a solenoid of the regeneration valve 12. The controller 19 has a CPU 19*a* in which a program is embedded, performs, based on the program, predetermined calculation processing on detection values of the pressure sensor 3, pressure sensor 14, and inertial measurement unit 31 input to the controller 19, and generates a control signal for the pump flow rate regulation device 20 and the solenoid of the regeneration valve 12.

The arm 16 is a first front part that can move in the free fall direction, and the arm cylinder 9 is a first actuator that is a hydraulic cylinder type for driving the first front part (arm 16). Here, the "free fall direction" means a moving direction in which the arm 16 falls freely vertically downward about the point of pivoting between the arm 16 and the boom 205 due to the weight of the arm 16 and bucket 35 (the weight of earth and sand is included when the bucket 35 is holding earth and sand), and "the arm 16 moves in the free fall direction" can be expressed in other words as that "the arm 16 moves vertically downward."

In addition, in the present embodiment, the regeneration line 10 and check valve 11 constitute a regenerating circuit 41 that supplies a hydraulic fluid discharged from the hydraulic fluid discharge-side (rod-side chamber 9*r*) of the first actuator (arm cylinder 9) to the hydraulic fluid supply-side of a second actuator. In the present embodiment, the second actuator is the same actuator (arm cylinder 9) as the first actuator, and the arm cylinder 9 doubles as the first actuator and second actuator. In addition, the regeneration valve 12 constitutes a regeneration control device that controls the regenerating state of the regenerating circuit 41.

Figure 2:
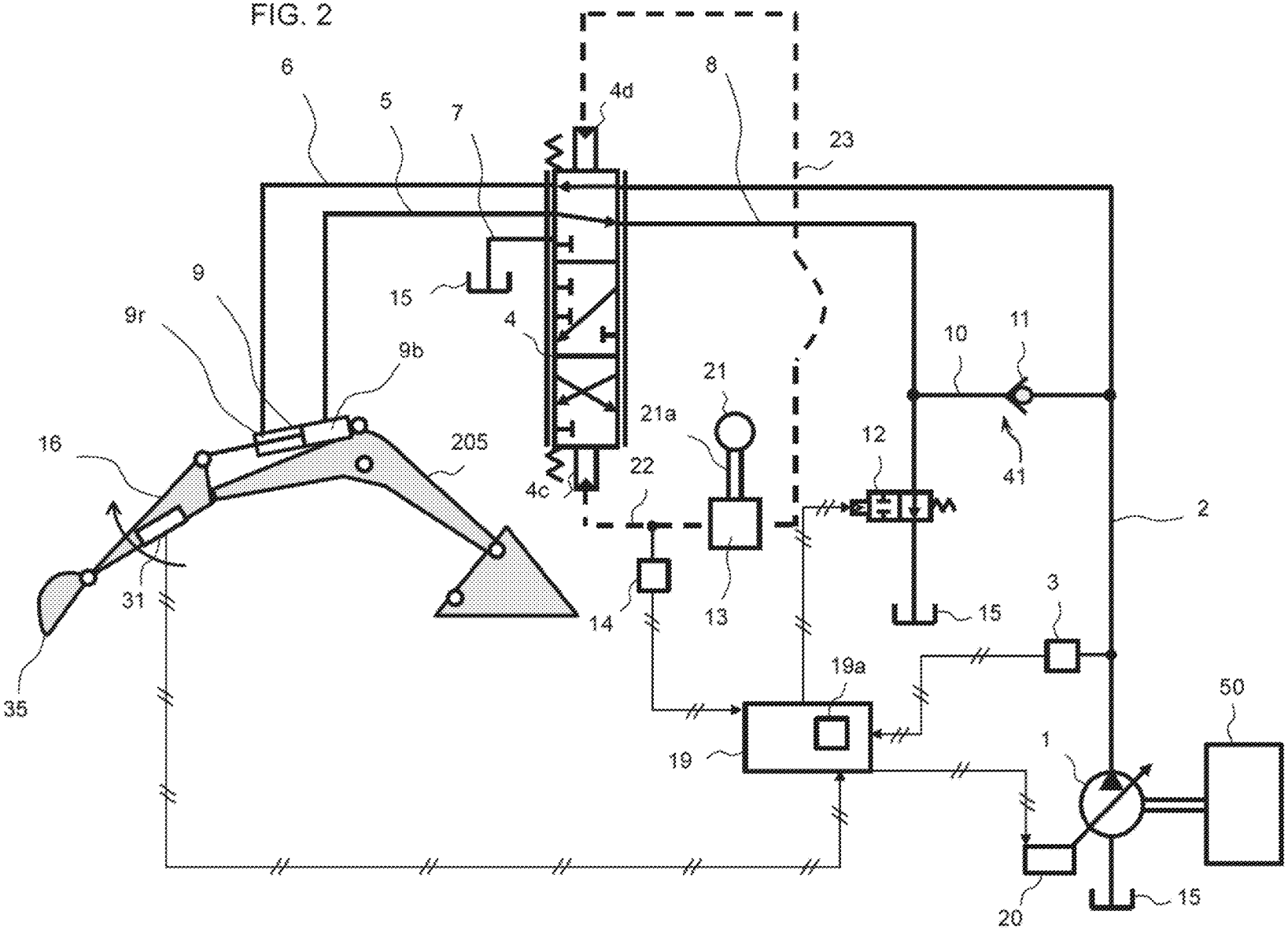
FIG. 2 is a figure illustrating the hydraulic system provided to the work machine, of the first embodiment of the present invention, the figure illustrating a case where there is input to the operation lever in the arm dumping direction.
Figure 3:
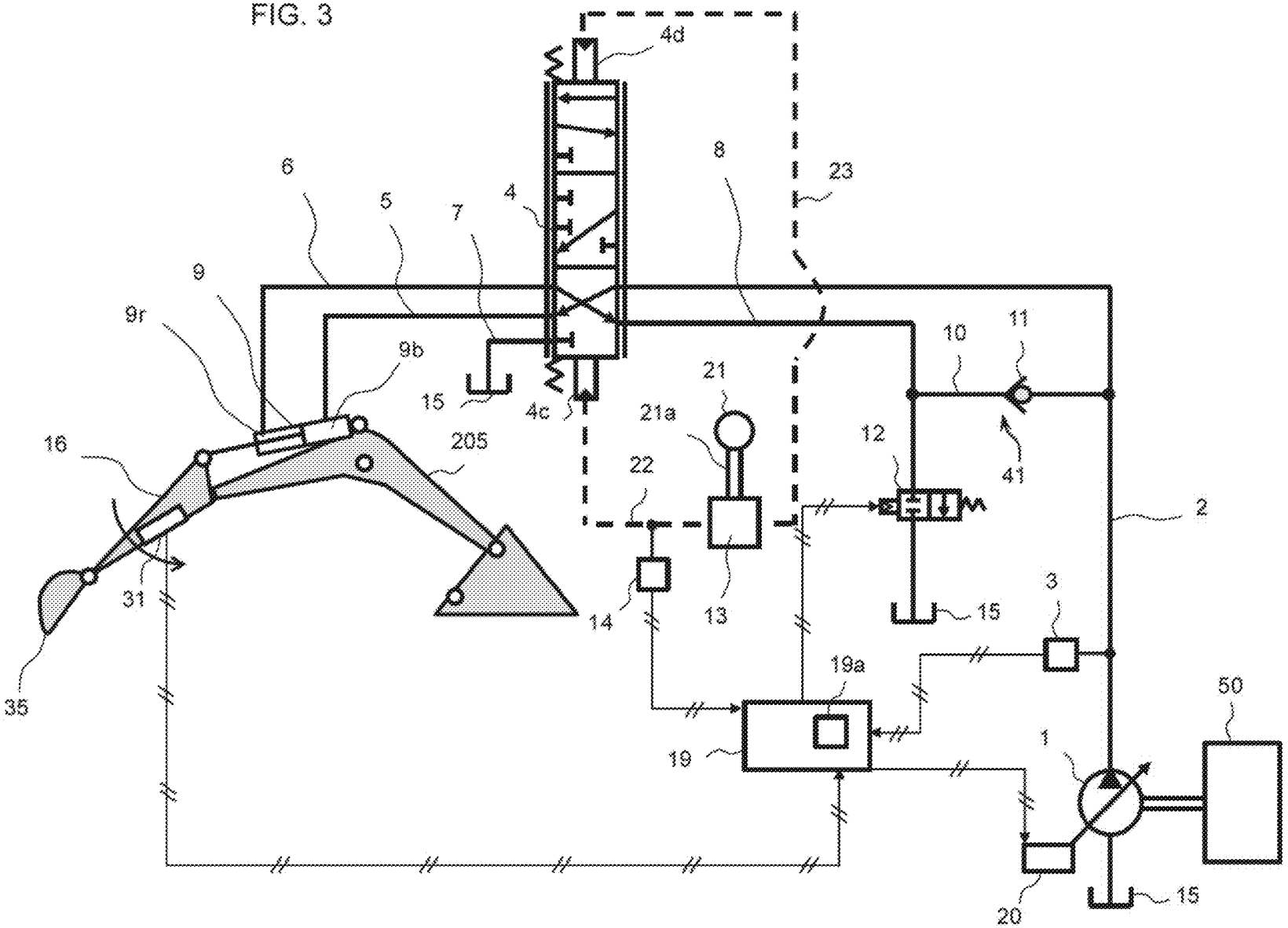
FIG. 3 is a figure illustrating the hydraulic system provided to the work machine, of the first embodiment of the present invention, the figure illustrating a case where there is input to the operation lever in the arm crowding direction.

Next, basic operations of the present embodiment are explained by using FIG. 1 to FIG. 3.

FIG. 1 illustrates a case where there is no input to the operation lever 21*a*, the hydraulic fluid supply line 2 communicates with the center bypass line 7 via the directional control valve 4, and the regeneration valve 12 is open. In this case, hydraulic fluid from the hydraulic pump 1 passes through the hydraulic fluid supply line 2, passes through the directional control valve 4, flows into the center bypass line 7, and then is fed back to the tank 15.

FIG. 2 illustrates a case where, due to input to the operation lever 21*a* in the arm dumping direction, the pressure transmitted to the operation port 4*d* of the directional control valve 4 increases, the hydraulic fluid supply line 2 communicates with the rod line 6, the bottom line 5 communicates with the tank line 8, and the regeneration valve 12 is open. In this case, hydraulic fluid from the hydraulic pump 1 passes through the hydraulic fluid supply line 2, passes through the directional control valve 4, flows into the rod line 6, and flows into the rod-side chamber 9*r* of the arm cylinder 9. At the same time, the hydraulic fluid discharged from the bottom-side chamber 9*b* of the arm cylinder 9 passes through the bottom line 5, passes through the directional control valve 4, and is fed to the tank line 8. Here, since the regeneration valve 12 is open, the hydraulic fluid in the tank line 8 passes through the regeneration valve 12, and is fed back to the tank 15.

FIG. 3 illustrates a case where, due to input to the operation lever 21*a* in the arm crowding direction, the pressure applied to the operation port 4*c* of the directional control valve 4 increases, the hydraulic fluid supply line 2 communicates with the bottom line 5, the rod line 6 communicates with the tank line 8, and the regeneration valve 12 is closed. In this case, hydraulic fluid from the hydraulic pump 1 passes through the hydraulic fluid supply line 2, passes through the directional control valve 4, flows into the bottom line 5, and flows into the bottom-side chamber 9*b* of the arm cylinder 9. At the same time, the hydraulic fluid discharged from the rod-side chamber 9*r* of the arm cylinder 9 passes through the rod line 6, passes through the directional control valve 4, and is fed to the tank line 8. Here, since the regeneration valve 12 is closed, the hydraulic fluid in the tank line 8 passes through the regeneration line 10 and check valve 11, and regenerated toward the hydraulic fluid supply line 2 of the hydraulic pump 1. The regeneration valve 12 is controlled to be closed when the arm 16 moves in the free fall direction due to gravity, and otherwise to switch to be open. When the regeneration valve 12 is open, the hydraulic fluid in the tank line 8 passes through the regeneration valve 12 and is fed back to the tank 15.

Figure 4:
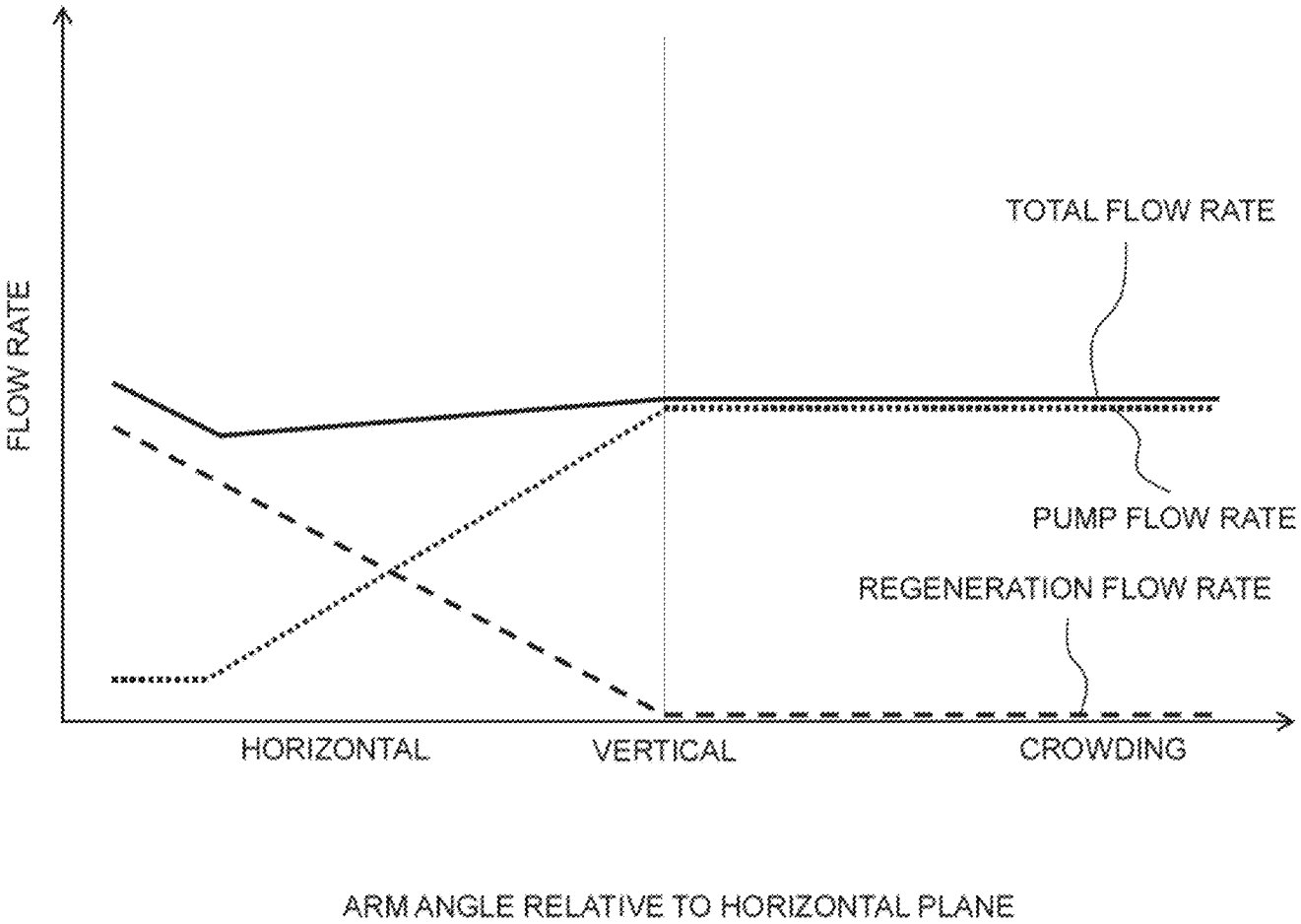
FIG. 4 is a figure illustrating a relationship between the regeneration flow rate and the delivery flow rate of a hydraulic pump in the case where a regeneration valve is closed, and a regenerating circuit is in the regenerating state.

Next, a relationship between the regeneration flow rate and the delivery flow rate of the hydraulic pump 1 that is observed when the regeneration valve 12 is closed and the regenerating circuit 41 is in the regenerating state as illustrated in FIG. 3 is explained by using FIG. 4. The vertical axis, and horizontal axis of the graph in FIG. 4 indicate the flow rate, and the angle of the arm 16 relative to the horizontal plane, respectively. The dotted line indicates the delivery flow rate of the hydraulic pump 1, the broken line indicates the regeneration flow rate, and the solid line indicates their total flow rate. As illustrated in FIG. 4, as the angle of the arm 16 is closer to the horizontal direction, the regeneration flow rate increases, and as the angle of the arm 16 is closer to the vertical direction, the regeneration flow rate decreases. According to this consideration, in the present embodiment, control is performed such that as the angle of the arm 16 is closer to the horizontal direction, the delivery flow rate of the hydraulic pump 1 is reduced, and as the angle of the arm 16 is closer to the vertical direction, the delivery flow rate of the hydraulic pump 1 is increased, thereby reducing changes in the rate of flow flowing into the bottom-side chamber 9*b* of the arm cylinder 9.

Next, conditions under which delivery flow rate reduction control of the hydraulic pump 1 is not performed in the present embodiment are explained.

First, under a condition 1 where there is no input to the operation lever 21*a* and pressure is not being guided to the operation port 4*c* of the directional control valve 4, and under a condition 2 where regeneration by the regenerating circuit 41 is not being performed, the delivery flow rate reduction control of the hydraulic pump 1 is not performed. In addition, also under a condition 3 where there is a possibility of occurrence of cavitation, the delivery flow rate reduction control of the hydraulic pump 1 is not performed. Here, the condition 3 where there is a possibility of occurrence of cavitation is explained by using FIG. 5.

Figure 5:
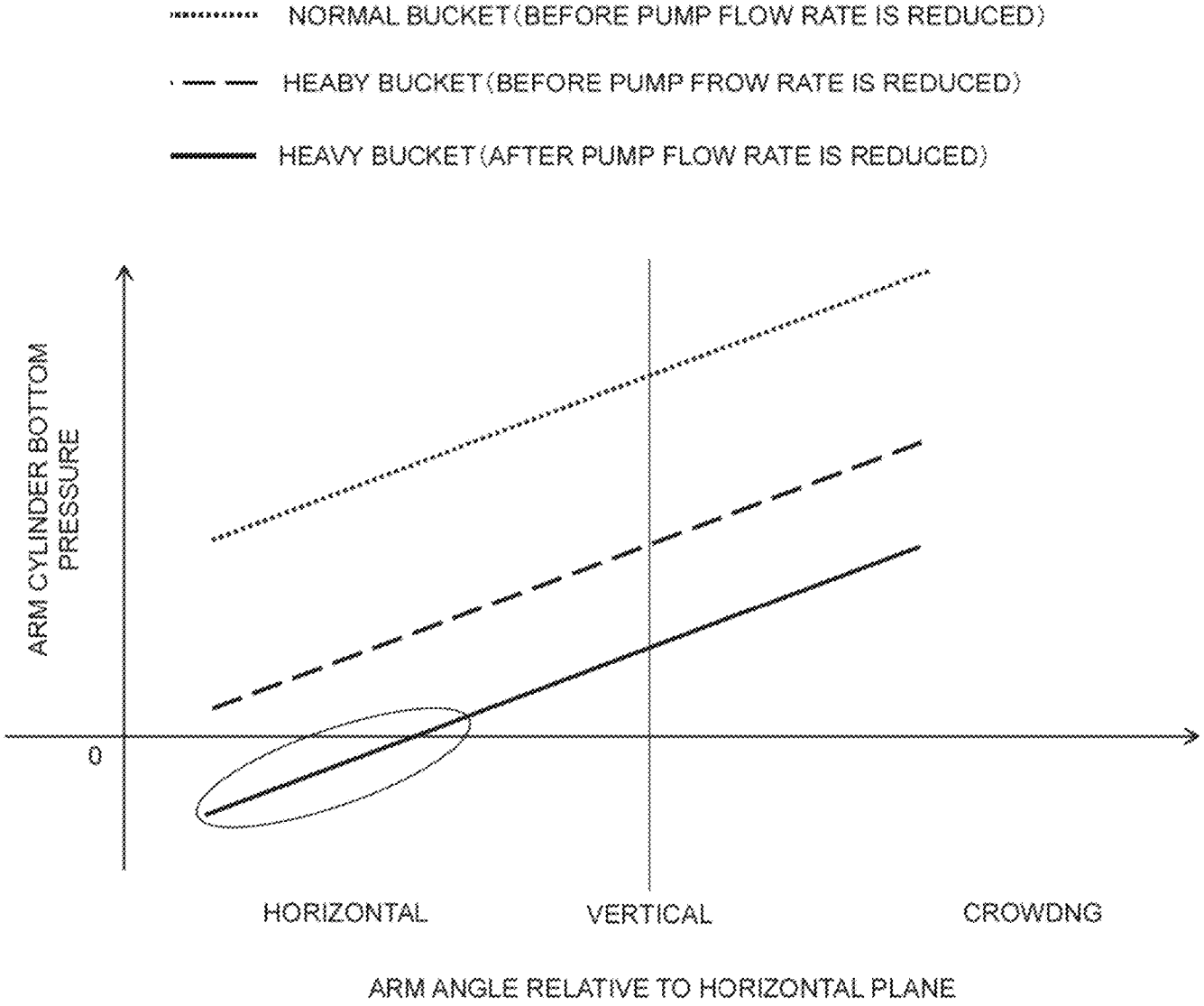
FIG. 5 is a figure illustrating a relationship between the arm angle relative to the horizontal plane and the pressure in the bottom-side chamber of an arm cylinder.

FIG. 5 illustrates a relationship between the angle of the arm 16 relative to the horizontal plane and the pressure in the bottom-side chamber 9*b* of the arm cylinder 9. The dotted line represents a case where the normal bucket 35 is attached to the front work implement 203, and the delivery flow rate of the hydraulic pump 1 is not reduced (a case where the delivery flow rate of the hydraulic pump 1 is controlled to increase according to the operation amount of the operation lever 21*a*); the broken line represents a case where a heavy attachment is attached instead of the bucket 35, and the delivery flow rate of the hydraulic pump 1 is not reduced; and the solid line represents a case where a heavy attachment is attached, and the delivery flow rate of the hydraulic pump 1 is reduced.

When the delivery flow rate of the hydraulic pump 1 is reduced, the pressure in the bottom-side chamber 9*b* of the arm cylinder 9 lowers as compared to the case where it is not reduced. In addition, when a heavy attachment is attached, an external force that is applied to the arm cylinder 9 becomes larger as compared to the case where a normal bucket is attached, and so the pressure in the bottom-side chamber 9*b* of the arm cylinder 9 lowers further.

Accordingly, when a heavy attachment is attached, and the delivery flow rate of the hydraulic pump 1 is reduced, as indicated by the portion encircled by a long circle in FIG. 5, the pressure in the bottom-side chamber 9*b* of the arm cylinder 9 becomes a negative value, and there is a possibility that cavitation might occur.

In view of this, by performing control such that in the range of the portion encircled by the long circle in FIG. 5, the delivery flow rate of the hydraulic pump 1 is not reduced, but is caused to transition along the broken line, and in ranges other than the portion encircled by the long circle, the delivery flow rate of the hydraulic pump 1 is reduced, and is caused to transition along the solid line, cavitation can be prevented while at the same time the fuel consumption is reduced.

As explained above, in the present embodiment, when the pressure in the bottom-side chamber 9*b* of the arm cylinder 9 becomes a negative value by reducing the delivery flow rate of the hydraulic pump 1, delivery flow rate reduction control of the hydraulic pump 1 is not to be performed.

Note that in the case of the present embodiment, the pressure in the bottom-side chamber 9*b* of the arm cylinder 9 is not measured directly, but since in the state illustrated in FIG. 3, there is a predetermined relationship between the pressure in the bottom-side chamber 9*b* of the arm cylinder 9 and the pressure of the hydraulic fluid supply line 2 connected with the bottom line 5 via the directional control valve 4, it becomes possible to determine the pressure in the bottom-side chamber 9*b* of the arm cylinder 9 by using a value of the pressure sensor 3 to measure the pressure of the hydraulic fluid supply line 2.

Figure 6:
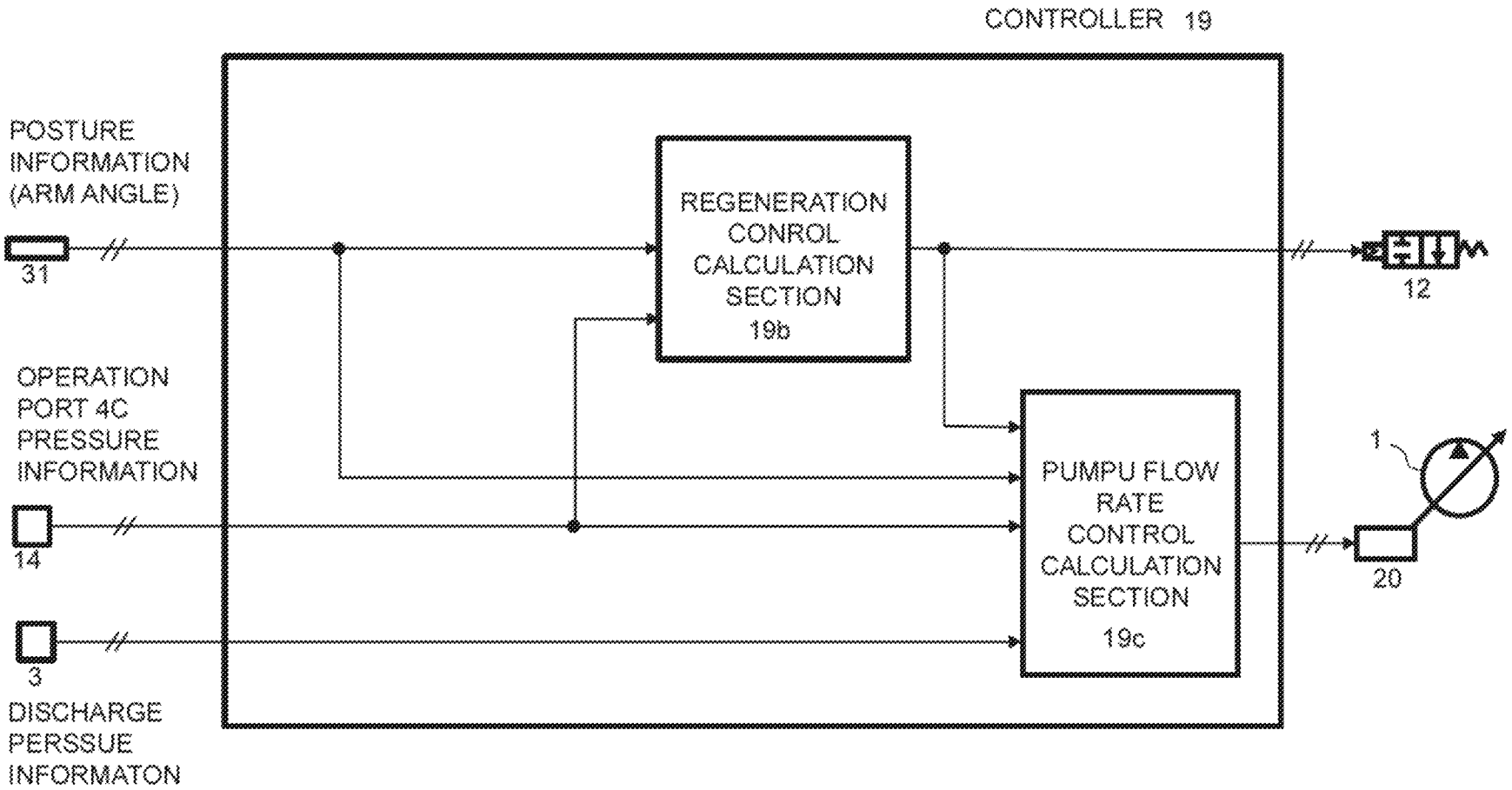
FIG. 6 is a functional block diagram illustrating contents of processing performed by a controller.

Next, contents of processing performed by the controller 19 are explained by using the functional block diagram of FIG. 6.

The controller 19 includes functions of a regeneration control calculation section 19*b*, and a pump flow rate control calculation section 19*c*.

The regeneration control calculation section 19*b* receives input of arm angle information which is posture information about the arm 16 from the inertial measurement unit 31, and pressure information (actuation direction information) about the operation port 4*c* from the pressure sensor 14, and calculates an excitation target value for the regeneration valve 12. Then, the regeneration control calculation section 19*b* outputs a signal indicative of the target value to the solenoid of the regeneration valve 12, and the pump flow rate control calculation section 19*c*.

The pump flow rate control calculation section 19*c* receives input of arm angle information, the excitation target value information about the solenoid of the regeneration valve 12, the pressure information (operation amount information) about the operation port 4*c* of the directional control valve 4, and delivery pressure information about the hydraulic pump 1 from the inertial measurement unit 31, the regeneration control calculation section 19*b*, the pressure sensor 14, and the pressure sensor 3, respectively, and calculates a delivery flow rate target value for the hydraulic pump 1. Then, the pump flow rate control calculation section 19*c* outputs a signal indicative of the target value to the pump flow rate regulation device 20.

Figure 7:
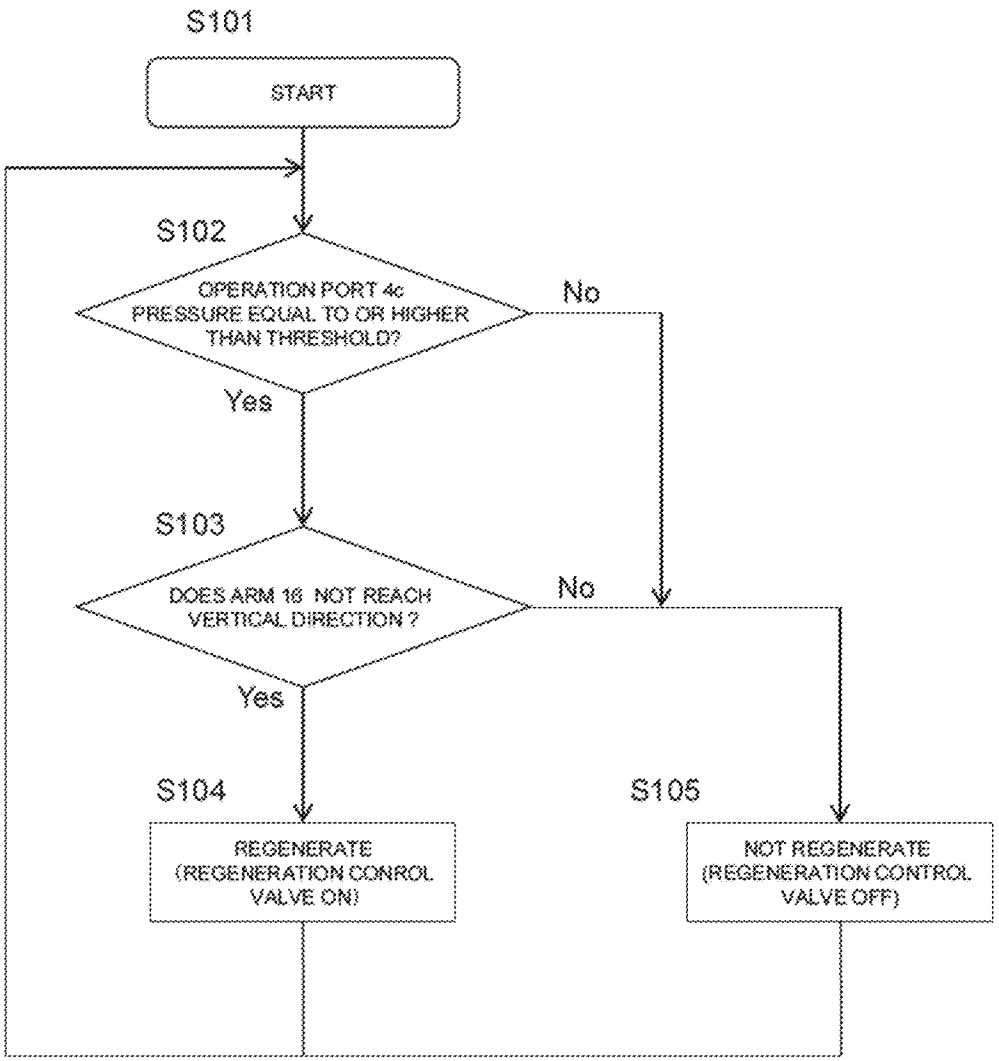
FIG. 7 is a flowchart illustrating a flow of processing performed by a regeneration control calculation section.
Figure 8:
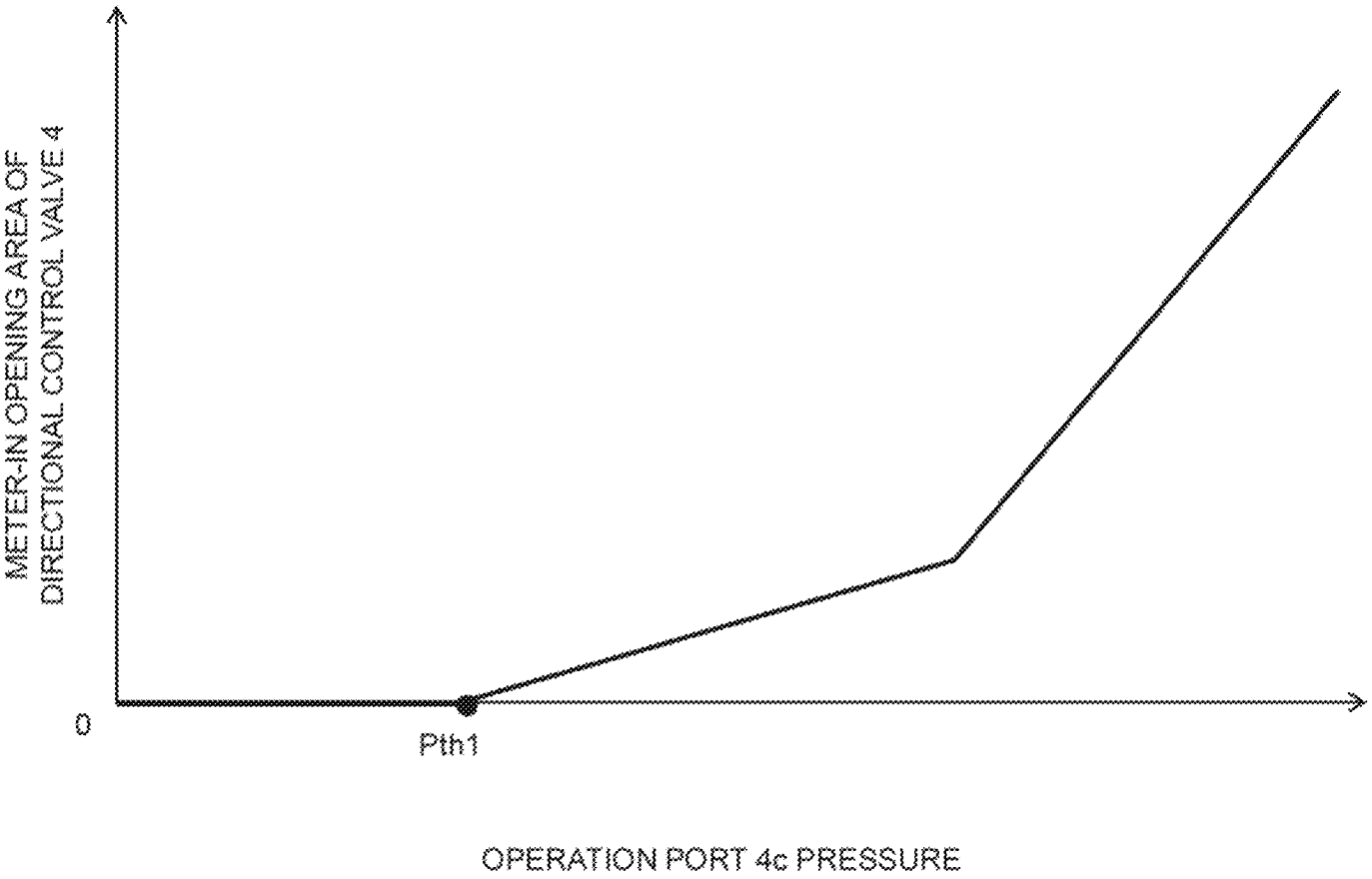
FIG. 8 is a figure illustrating meter-in opening area characteristics of a directional control valve.

Next, contents of processing performed by the regeneration control calculation section 19*b* are explained by using FIG. 7 and FIG. 8.

FIG. 7 illustrates a flow of processing performed by the regeneration control calculation section 19*b*, and while the controller 19 is in operation for example, the processing flow is repeated in a predetermined calculation cycle.

Upon activation of the controller 19, at Step S101, calculation processing of the regeneration control calculation section 19*b* starts.

First, at Step S102, the regeneration control calculation section 19*b* determines whether the pressure of the operation port 4*c* is equal to or higher than a predetermined threshold. This is determination to determine whether or not the arm 16 is moving in the free fall direction. When the pressure of the operation port 4*c* is equal to or higher than the predetermined threshold, the determination result at Step S102 is Yes, and the process continues on to processing at Step S103.

At Step S103, it is determined whether the posture of the arm 16 has reached the vertically downward direction. When the posture of the arm 16 does not reach the vertically downward direction, the process continues on to processing at Step S104.

At Step S104, it is determined to perform regeneration control of the arm cylinder 9. In this case, the regeneration control calculation section 19*b* calculates an excitation target value for exciting the solenoid of the regeneration valve 12, and outputs a signal indicative of the excitation target value.

When the determination result at Step S102 or S103 is No, the process continues on to processing at Step S105. At Step S105, it is determined not to perform regeneration control of the arm cylinder 9. In this case, the regeneration control calculation section 19*b* calculates an excitation target value for not exciting the solenoid of the regeneration valve 12, and outputs a signal indicative of the excitation target value.

Next, the predetermined threshold used at Step S102 in FIG. 7 is explained by using FIG. 8. FIG. 8 illustrates meter-in opening area characteristics of the directional control valve 4. The horizontal axis represents the pressure of the operation port 4*c*, and the vertical axis represents the meter-in opening area.

When the pressure of the operation port 4*c* becomes equal to or higher than a value Pth1 indicated in the figure, the area of the meter-in opening of the directional control valve 4 starts increasing from 0, and hydraulic fluid is supplied to the bottom-side chamber 9*b* of the arm cylinder 9 via the bottom line 5. Therefore, the predetermined threshold is set to Pth1.

Next, contents of processing performed by the pump flow rate control calculation section 19*c* are explained by using FIG. 9, FIG. 10, FIG. 11, and FIG. 12.

Figure 9:
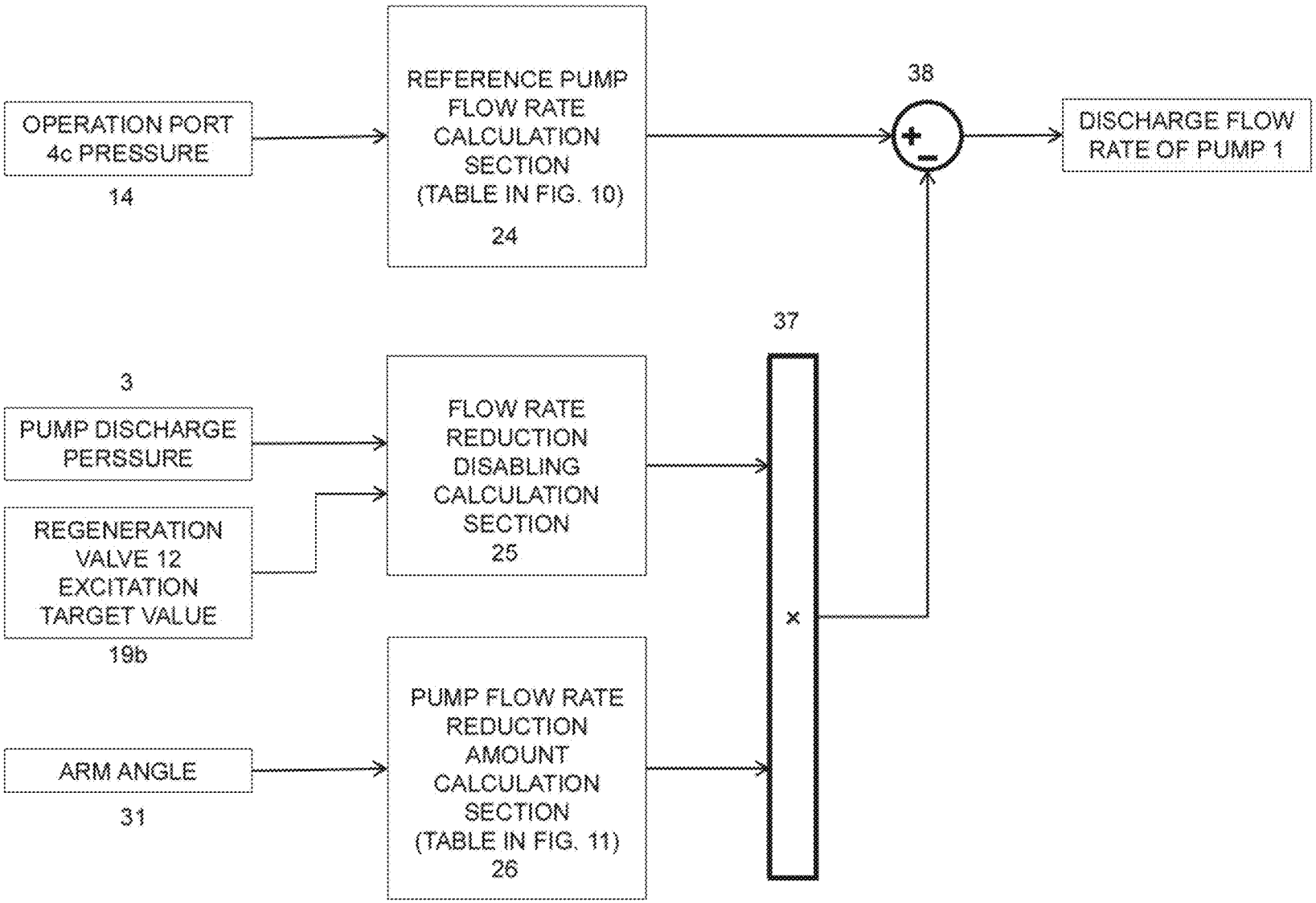
FIG. 9 is a functional block diagram illustrating contents of processing performed by a pump flow rate control calculation section.

FIG. 9 is a functional block diagram illustrating contents of processing performed by the pump flow rate control calculation section 19*c*.

The pump flow rate control calculation section 19*c* has functions of a reference pump flow rate calculation section 24, a flow rate reduction disabling calculation section 25, a pump flow rate reduction amount calculation section 26, a multiplying section 37, and a subtracting section 38.

Figure 10:
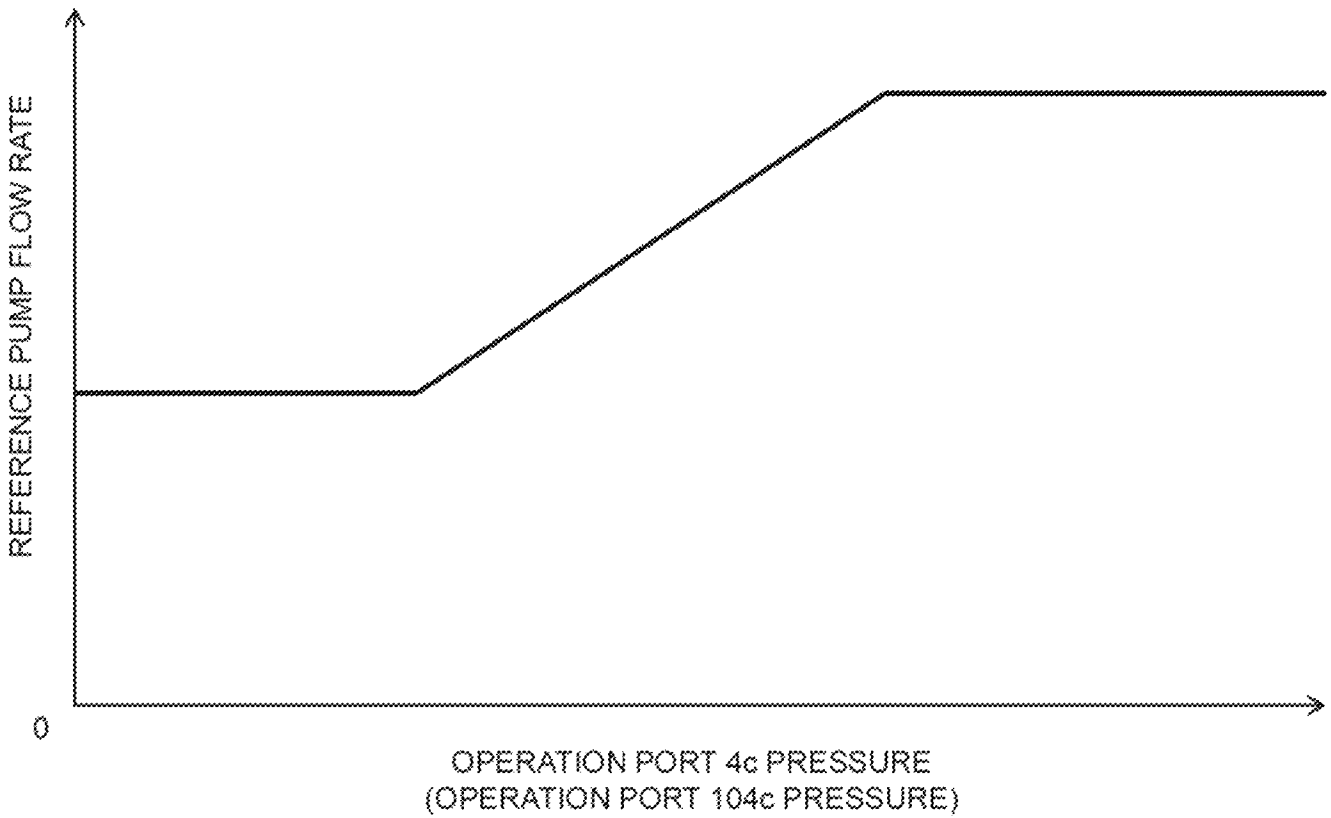
FIG. 10 is a figure illustrating a relationship between the pressure of an operation port and the reference pump flow rate of the hydraulic pump.

First, the reference pump flow rate calculation section 24 receives input of the pressure of the operation port 4*c*, and calculates a reference pump flow rate of the hydraulic pump 1. FIG. 10 is a figure illustrating a relationship between the pressure of the operation port 4*c* and the reference pump flow rate of the hydraulic pump 1. The reference pump flow rate is set to increase as the pressure of the operation port 4*c* rises. The reference pump flow rate calculation section 24 has a table having stored therein a relationship between the pressure of the operation port 4*c* and the reference pump flow rate of the hydraulic pump 1, receives input of the pressure of the operation port 4*c* into the table, and calculates the reference pump flow rate of the hydraulic pump 1.

Figure 11:
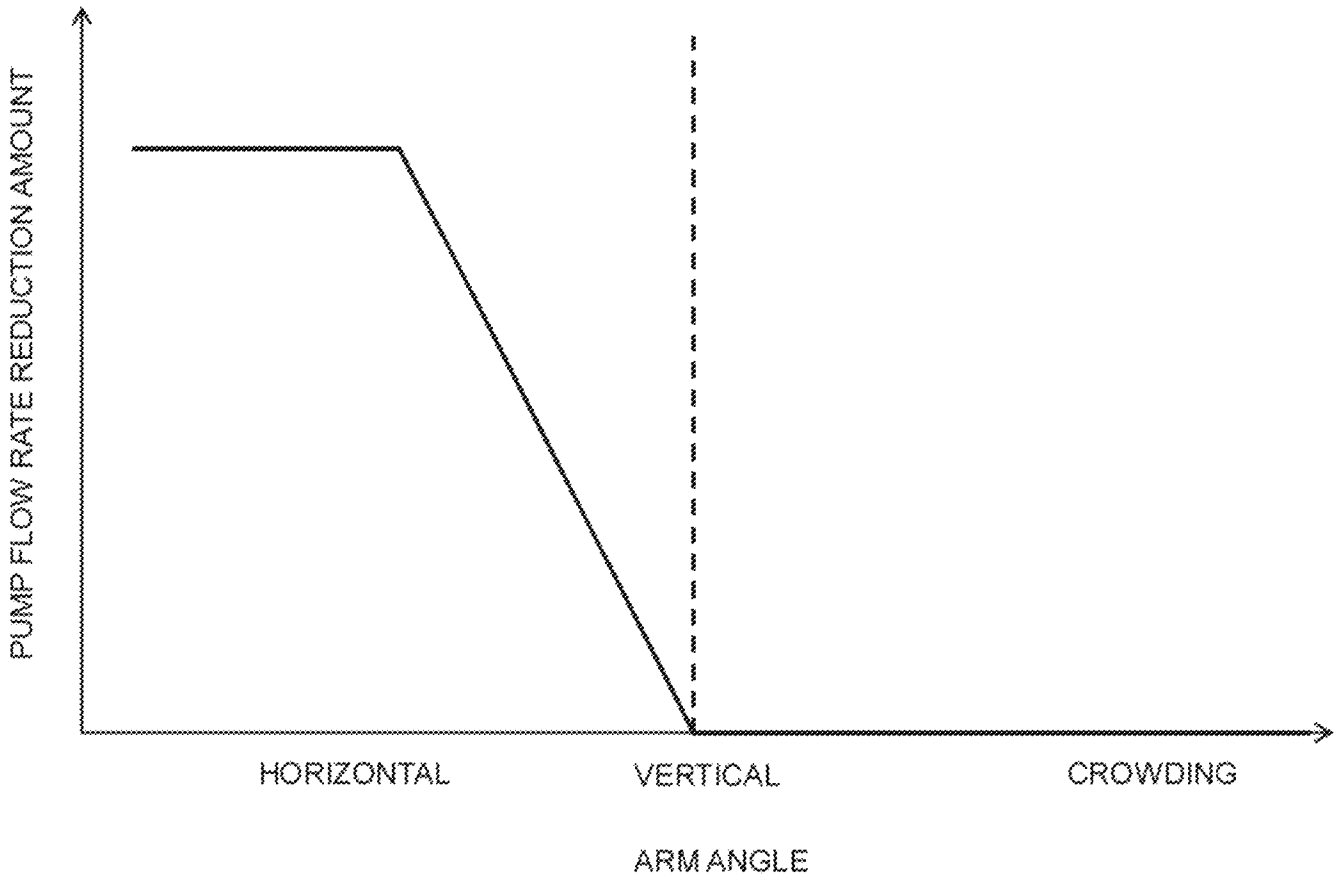
FIG. 11 is a figure illustrating a relationship between the arm angle and the pump flow rate reduction amount, which relationship is used for calculation performed by a pump flow rate reduction amount calculation section.

Next, the pump flow rate reduction amount calculation section 26 receives input of an arm angle relative to the horizontal plane, and calculates a reduction amount of the delivery flow rate of the hydraulic pump 1. FIG. 11 illustrates a relationship between the arm angle and the pump flow rate reduction amount, which relationship is used for the calculation by the pump flow rate reduction amount calculation section 26 illustrated in FIG. 9. The pump flow rate reduction amount is set to increase as the angle of the arm 16 is closer to the horizontal direction, decrease as the angle of the arm 16 approaches the vertically downward direction, and become 0 when the angle of the arm 16 has reached the vertically downward direction. The pump flow rate reduction amount calculation section 26 has a table having stored therein the relationship, receives input of an arm angle, and calculates a reduction amount of the delivery flow rate of the hydraulic pump 1. By doing so, the delivery flow rate of the hydraulic pump 1 is reduced when the angle of the arm 16 is closer to the horizontal direction, and the amount of hydraulic fluid flowing through the regeneration line 10 is large, and the output power of the hydraulic pump 1 lowers, thereby enhancing fuel efficiency. In addition, the speed no longer easily lowers because the delivery flow rate of the hydraulic pump 1 successively increases even when the angle of the arm has reached the vertically downward direction, the solenoid of the regeneration valve 12 has entered the non-excited state, and the flow rate of hydraulic fluid flowing through the regeneration line 10 has become 0.

Next, the flow rate reduction disabling calculation section 25 receives input of the delivery pressure of the hydraulic pump 1 and the excitation target value for the regeneration valve 12 to perform reduction disabling calculation for the delivery flow rate of the hydraulic pump 1. At this time, when reduction of the delivery flow rate of the hydraulic pump 1 is to be disabled, 0 is output, and when reduction of the delivery flow rate of the hydraulic pump 1 is not to be disabled, 1 is output.

Figure 12:
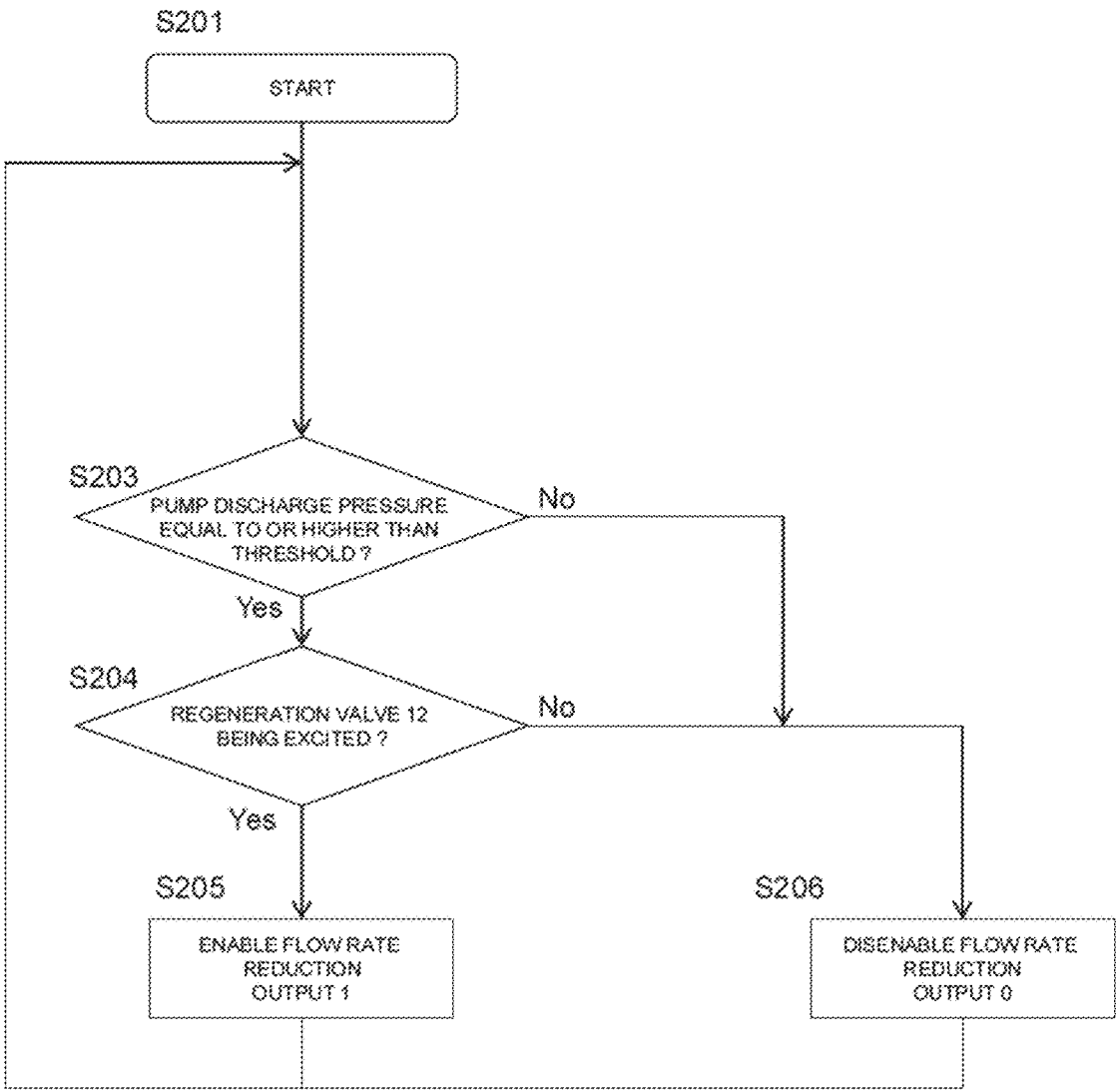
FIG. 12 is a flowchart illustrating a flow of processing performed by a flow rate reduction disabling calculation section.

FIG. 12 illustrates a flow of processing performed by the flow rate reduction disabling calculation section 25 illustrated in FIG. 9. This processing flow is repeated in a predetermined calculation cycle while the controller 19 is in operation, for example.

Upon activation of the controller 19, at Step S201, calculation processing of the flow rate reduction disabling calculation section 25 starts.

First, at Step S203, the flow rate reduction disabling calculation section 25 determines whether the delivery pressure of the hydraulic pump 1 is equal to or higher than a predetermined threshold. This is determination for preventing occurrences of cavitation due to the pressure in the bottom-side chamber 9*b* of the arm cylinder 9 becoming a negative value. When the delivery pressure of the hydraulic pump 1 is equal to or higher than the predetermined threshold, the result of determination at Step S203 is Yes, and the process continues on to processing at Step S204.

At Step S204, it is determined whether the solenoid of the regeneration valve 12 is being excited. When a signal to excite the solenoid of the regeneration valve 12 is being input, the result of determination at Step S204 is Yes, and the process continues on to processing at Step S205. When any of the results of determination at Step S203 and S204 is No, the process continues on to processing at Step S206.

At Step S205, it is determined to perform reduction of the delivery flow rate of the hydraulic pump 1, and 1 is output. At Step S206, it is determined not to perform reduction of the delivery flow rate of the hydraulic pump 1, and 0 is output.

Figure 13:
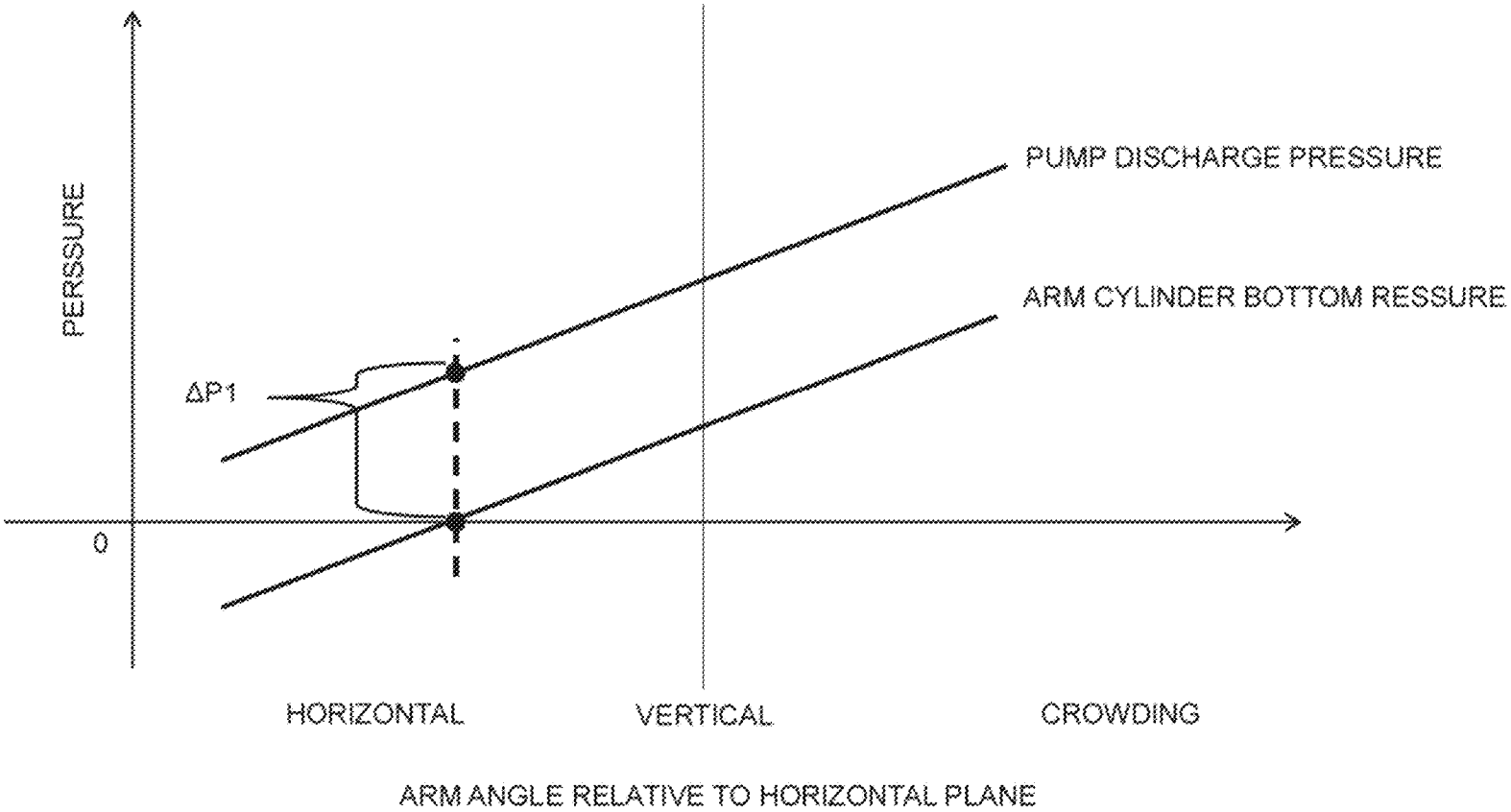
FIG. 13 illustrates a relationship between the delivery pressure of a hydraulic pump and the pressure in the bottom-side chamber of an arm cylinder in the case where the delivery flow rate of the hydraulic pump is reduced with a heavy attachment being attached.

Next, the predetermined threshold used as Step S203 illustrated in FIG. 12 is explained by using FIG. 13.

FIG. 13 illustrates a relationship between the delivery pressure of the hydraulic pump 1 and the pressure in the bottom-side chamber 9*b* of the arm cylinder 9 in the case where the delivery flow rate of the hydraulic pump 1 is reduced when a heavy attachment is attached. Due to a loss in a line, the pressure in the bottom-side chamber 9*b* of the arm cylinder 9 becomes a value smaller the delivery pressure of the hydraulic pump 1. When it is assumed that the value of the pressure difference is $\Delta P1$, the delivery pressure of the hydraulic pump 1 when the pressure in the bottom-side chamber 9*b* of the arm cylinder 9 is 0 MPa is $\Delta P1$. This value $\Delta P1$ is used as the predetermined threshold.

After the reduction amount of the delivery flow rate of the hydraulic pump 1 is calculated at the pump flow rate reduction amount calculation section 26, and the reduction disabling calculation for the delivery flow rate of the hydraulic pump 1 is performed at the flow rate reduction disabling calculation section 25 in the manner explained above, the output of the pump flow rate reduction amount calculation section 26, and the output of the flow rate reduction disabling calculation section 25 are multiplied by the multiplying section 37, and the product is subtracted from the output value of the reference pump flow rate calculation section 24 at the subtracting section 38. This value serves as a finally used target value of the delivery flow rate of the hydraulic pump 1.

In the thus-configured present embodiment, by performing control such that when the angle of the arm 16 is closer to the horizontal direction, the delivery flow rate of the hydraulic pump 1 is reduced, and as the angle of the arm 16 is closer to the vertically downward direction, the delivery flow rate of the hydraulic pump 1 is increased successively, it is possible to suppress speed reduction of the arm 16 and maintain the operability while at the same time output power of the hydraulic pump 1 is lowered, and fuel efficiency is enhanced.

In addition, even when a heavy attachment is attached to the front work implement 203, reduction of the delivery flow rate of the hydraulic pump 1 is not performed when the delivery pressure of the hydraulic pump 1 is not equal to or higher than the predetermined threshold; therefore, the pressure in the bottom-side chamber 9*b* of the arm cylinder 9 does not become a negative value, and it is possible to prevent cavitation while at the same time the fuel consumption is reduced.

Note that at Step S102 illustrated in FIG. 7, information about an arm angle from the inertial measurement unit 31 can also be used instead of information from the pressure sensor 14, to determine whether or not the arm 16 is moving in the free fall direction (moving toward the vertically downward direction). In that case, the regeneration control calculation section 19*b* illustrated in FIG. 6 receives input of an arm angle from the inertial measurement unit 31 instead of the pressure of the operation port 4*c*. In addition, at Step S103 illustrated in FIG. 7, information about an arm angle from the inertial measurement unit 31 is used to compare an arm angle at the previous step and the current arm angle, for example, and determine whether or not the arm 16 is moving toward the vertically downward direction. Thereby, the regeneration control calculation section 19*b* illustrated in FIG. 6 can use not the pressure of the operation port 4*c*, but only information from the inertial measurement unit 31 to determine whether or not to perform regeneration control of the arm cylinder 9.

In addition, information from a stroke sensor (amount-of-movement measuring device) that measures the stroke amount of the directional control valve 4 can also be used instead of information from the pressure sensor 14, to determine whether or not the arm 16 is moving in the free fall direction. In that case, the regeneration control calculation section 19*b* illustrated in FIG. 6 receives input of the stroke amount of the directional control valve 4 instead of the pressure of the operation port 4*c*. In addition, at Step S103 illustrated in FIG. 7, the stroke amount of the directional control valve 4 is used to determine whether or not the arm 16 is moving vertically downward.

Furthermore, when the operation lever device 21 is an electric lever device that outputs an electrical signal corresponding to an operation amount of the operation lever 21*a*, and a command value for the movement amount of the directional control valve 4 is calculated at the controller 19, the command value can also be used to determine the moving direction of the arm 16. In that case, the regeneration control calculation section 19*b* illustrated in FIG. 6 receives input of the command value for the movement amount of the directional control valve 4 instead of the pressure of the operation port 4*c*. In addition, at Step S103 illustrated in FIG. 7, it is determined whether or not the arm 16 is moving vertically downward by determining whether or not the command value for the movement amount of the directional control valve 4 is equal to or higher than a threshold.

Second Embodiment

Figure 14:
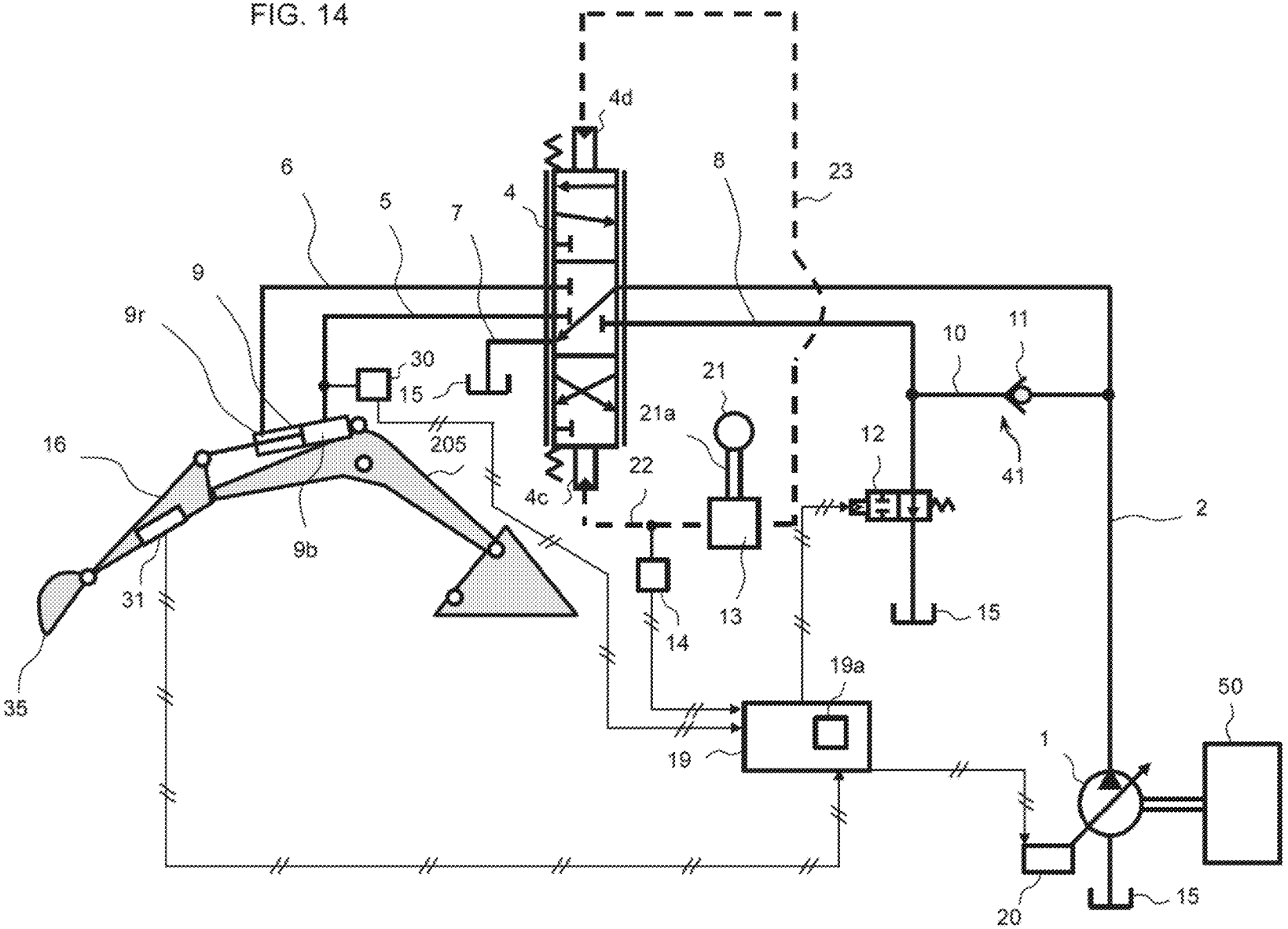
FIG. 14 is a figure illustrating a hydraulic system provided to a work machine, of a second embodiment of the present invention, the figure illustrating a case where there is no input to an operation lever.
Figure 15:
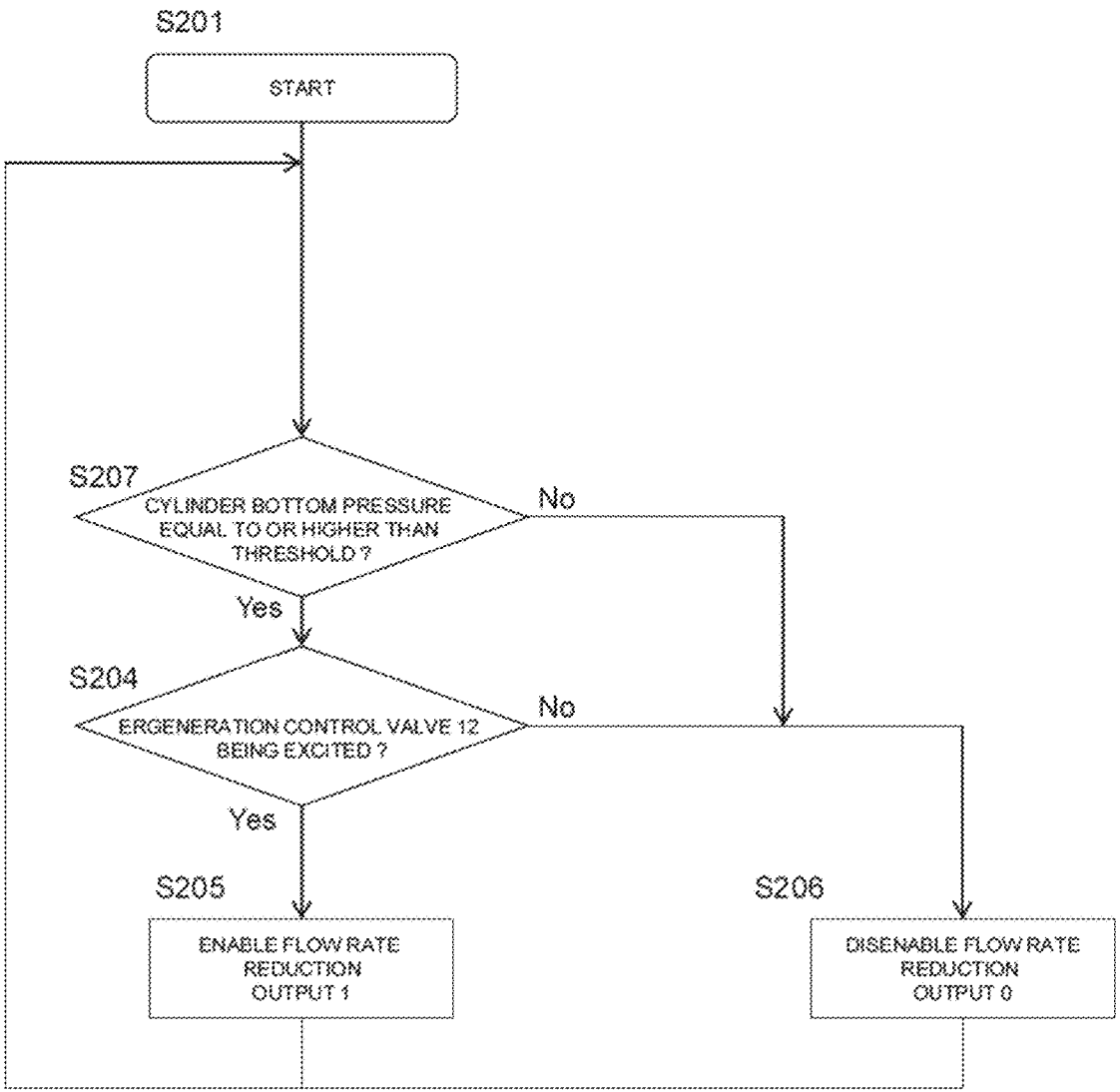
FIG. 15 is a flowchart illustrating a flow of processing performed by a flow rate reduction disabling calculation section.

A hydraulic system of a work machine according to a second embodiment of the present invention is explained by using FIG. 14 and FIG. 15. Note that explanations of portions similar to the first embodiment are omitted.

The present embodiment illustrated in FIG. 14 is different from the first embodiment in that, instead of the pressure sensor 3 attached to the hydraulic fluid supply line 2, a pressure sensor 30 for measuring the pressure in a bottom-side chamber 9*b* of the arm cylinder 9 is attached to the bottom line 5 as a pressure information acquiring device to acquire the pressure on the hydraulic fluid inflow-side of the arm cylinder 9 (first actuator). The pressure sensor 30 is electrically connected to the controller 19.

FIG. 15 illustrates a flow of processing performed by the flow rate reduction disabling calculation section 25 in the second embodiment. FIG. 15 is different from FIG. 12 of the first embodiment in that Step S203 is replaced by Step S207. Although, at Step S203, it is determined whether the delivery pressure of the hydraulic pump 1 is equal to or higher than a predetermined threshold, at Step S207, it is determined whether the bottom pressure of the arm cylinder 9 measured by the pressure sensor 30 is equal to or higher than a predetermined threshold (e.g., 0 MPa). Thereby, conditions that lead to occurrences of cavitation can be sensed more accurately than in the first embodiment.

According to the present embodiment, the pressure in the bottom-side chamber 9*b* of the arm cylinder 9 can be measured more accurately than in the first embodiment; therefore, cavitation can be avoided more efficiently.

Third Embodiment

Figure 16:
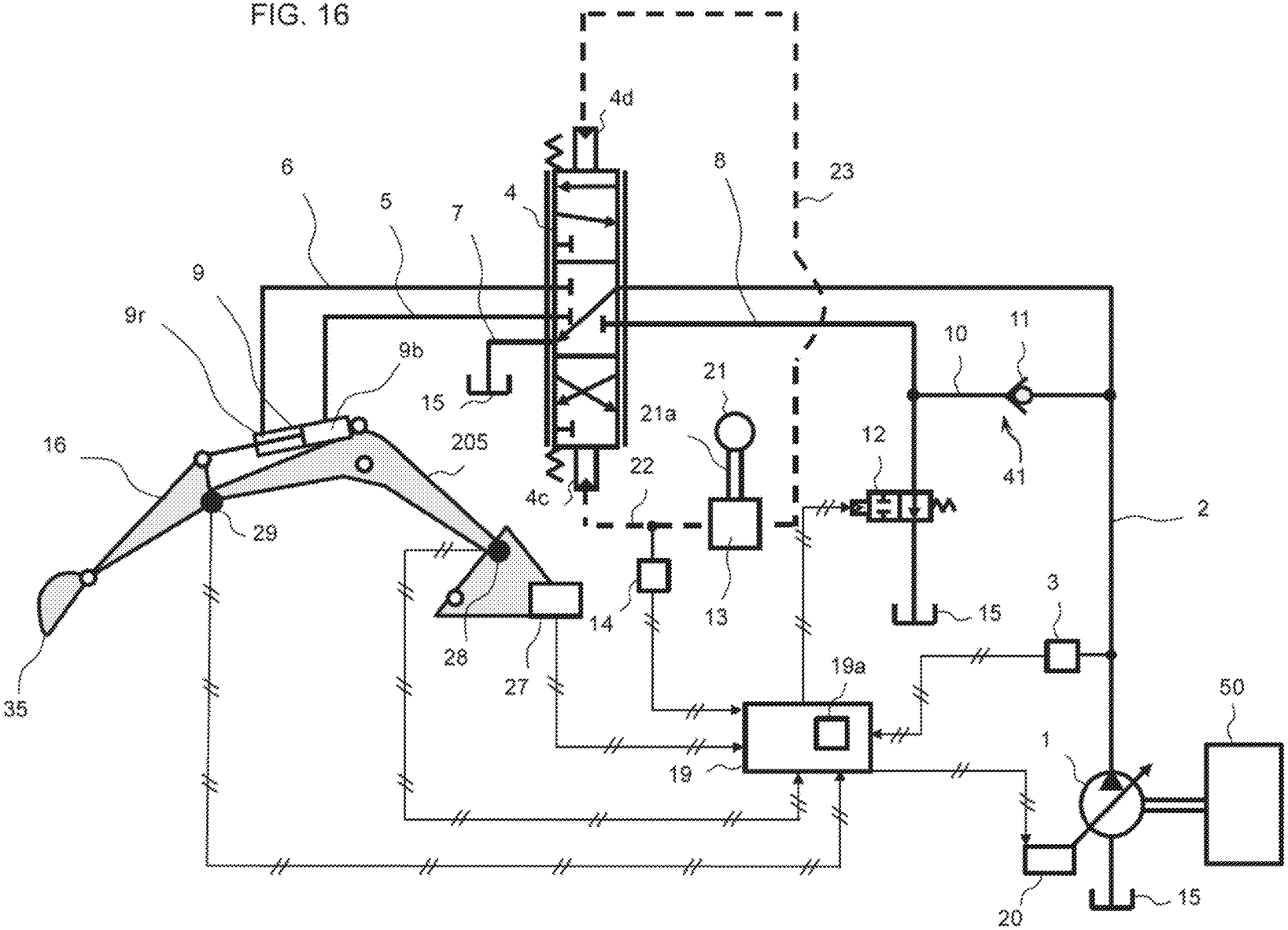
FIG. 16 is a figure illustrating a hydraulic system provided to a work machine, of a third embodiment of the present invention, the figure illustrating a case where there is no input to an operation lever.
Figure 17:
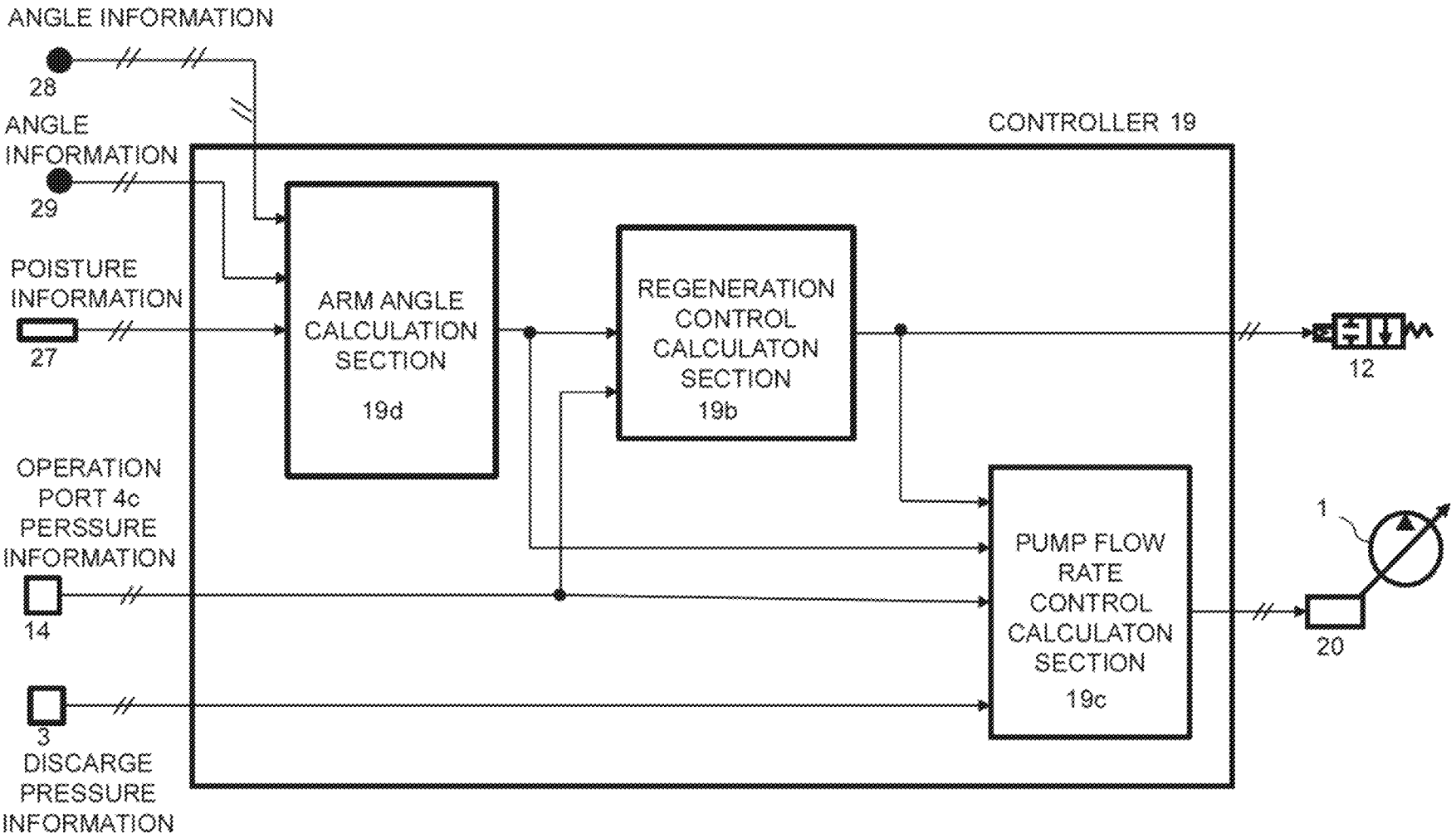
FIG. 17 is a functional block diagram illustrating contents of processing performed by a controller.
Figure 18:
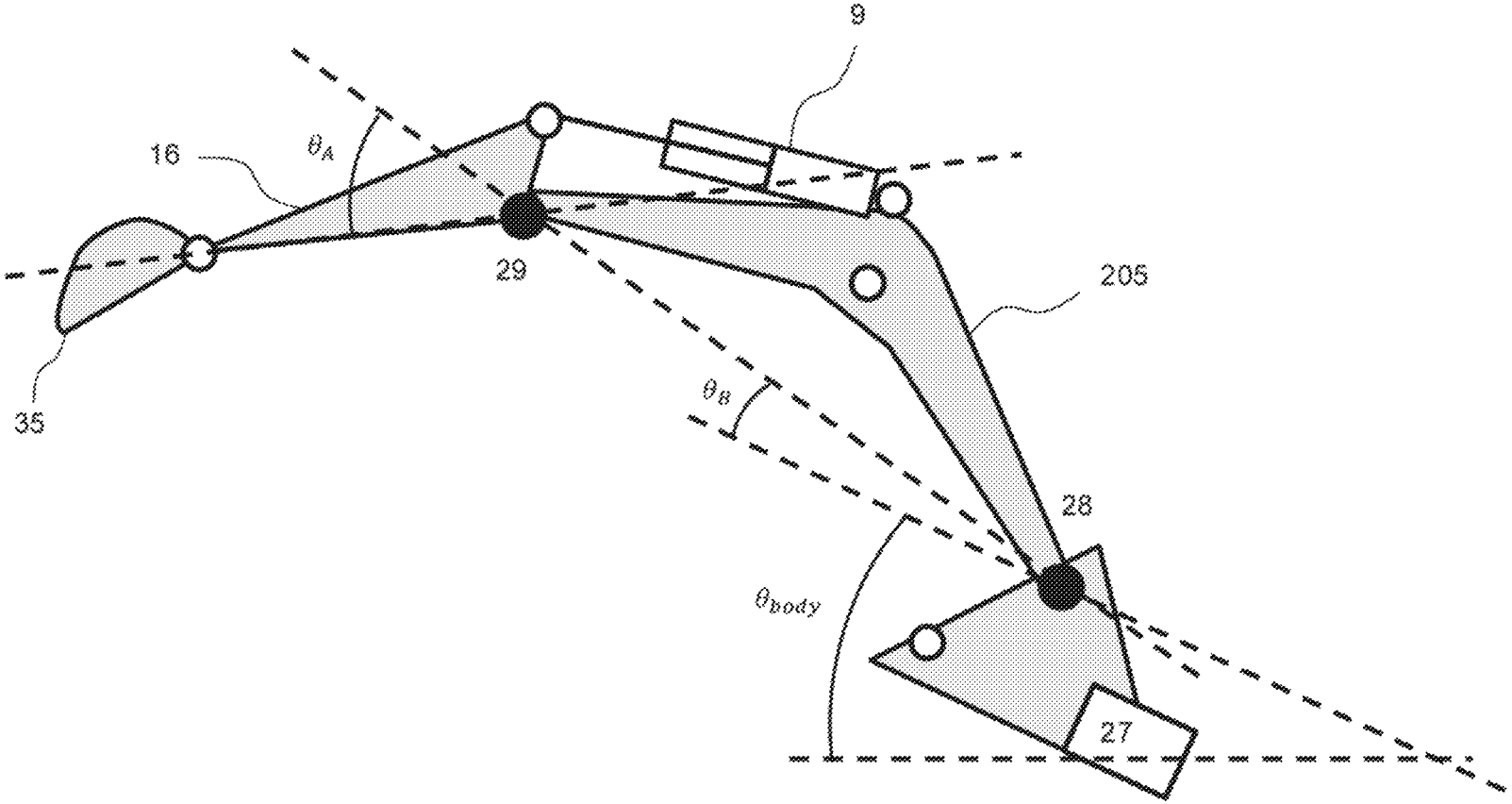
FIG. 18 is a figure for explaining contents of calculation of posture information about an arm (arm angle) at an arm angle calculation section.

A hydraulic system of a work machine according to a third embodiment of the present invention is explained by using FIG. 16 to FIG. 18. Note that explanations of portions similar to the first embodiment are omitted.

First, the configuration of the third embodiment is explained by using FIG. 16. A difference from the first embodiment is that, as posture information acquiring devices, an angular velocity sensor 27 to measure the angular velocity of the machine body (the lower track structure 201 and upper swing structure 202) relative to the horizontal plane, an angle sensor 28 to measure the angle formed by the machine body and the boom, and an angle sensor 29 to measure the angle formed by the boom and the arm are attached, instead of the inertial measurement unit 31 attached to the arm 16. The angular velocity sensor 27 detects the angular velocity of the machine body at each time point, and integrates them to determine the angle of the machine body relative to the horizontal plane. The angular velocity sensor 27, angle sensor 28, and angle sensor 29 are each electrically connected with the controller 19.

Next, contents of processing performed by the controller 19 are explained by using FIG. 17. Differences from the first embodiment are that the controller 19 further includes an arm angle calculation section 19*d*, and that, instead of posture information input from the inertial measurement unit 31, information from the angular velocity sensor 27, angle sensor 28, and angle sensor 29 is input, and the arm angle calculation section 19*d* uses the information to calculate posture information about the arm. The regeneration control calculation section 19*b*, and pump flow rate control calculation section 19*c* perform calculation similar to that in the first embodiment based on the posture information about the arm 16 output from the arm angle calculation section 19*d*.

Next, contents of calculation performed by the arm angle calculation section 19*d* are explained by using FIG. 18. The arm angle calculation section 19*d* acquires: an inclination θbody of the machine body relative to the horizontal plane from the angular velocity sensor 27; an angle θB formed by the machine body and a straight line linking the point of coupling between the machine body and the boom 205 and the point of coupling between the arm 16 and the boom 205, from the angle sensor 28; and an angle θA formed by a straight line linking the point of coupling between the arm 16 and the boom 205 and the point of coupling between the arm 16 and the bucket 35, and a straight line linking the point of coupling between the machine body and the boom and the point of coupling between the arm 16 and the boom 205, from the angle sensor 29. At this time, the arm angle θArm relative to the horizontal plane can be determined by using Formula described in FIG. 16.

Effects similar to those attained in the first embodiment can be attained according to the present embodiment also.

Fourth Embodiment

Figure 19:
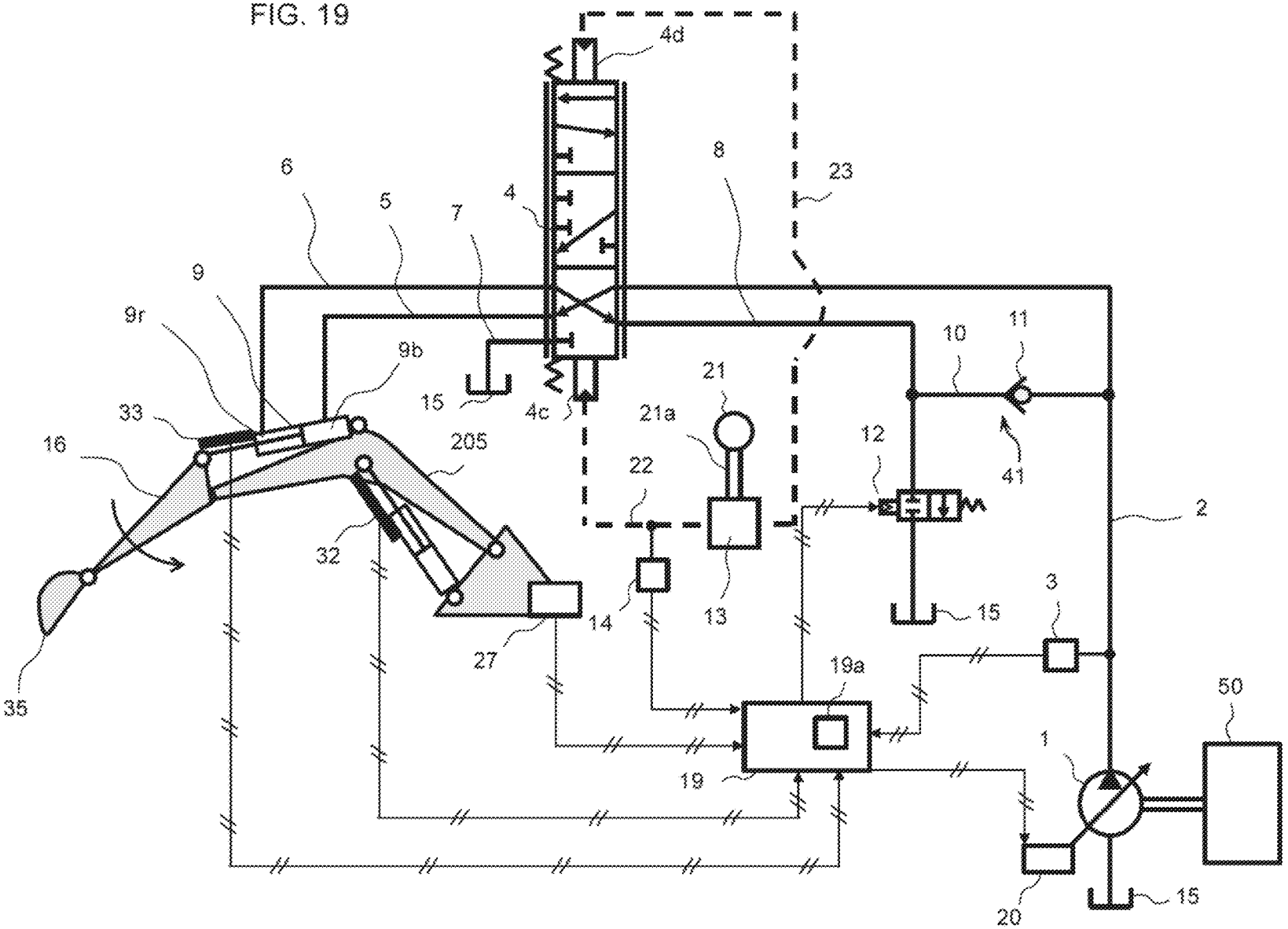
FIG. 19 is a figure illustrating a hydraulic system provided to a work machine, of a fourth embodiment of the present invention, the figure illustrating a case where there is input to an operation lever in the arm crowding direction.
Figure 20:
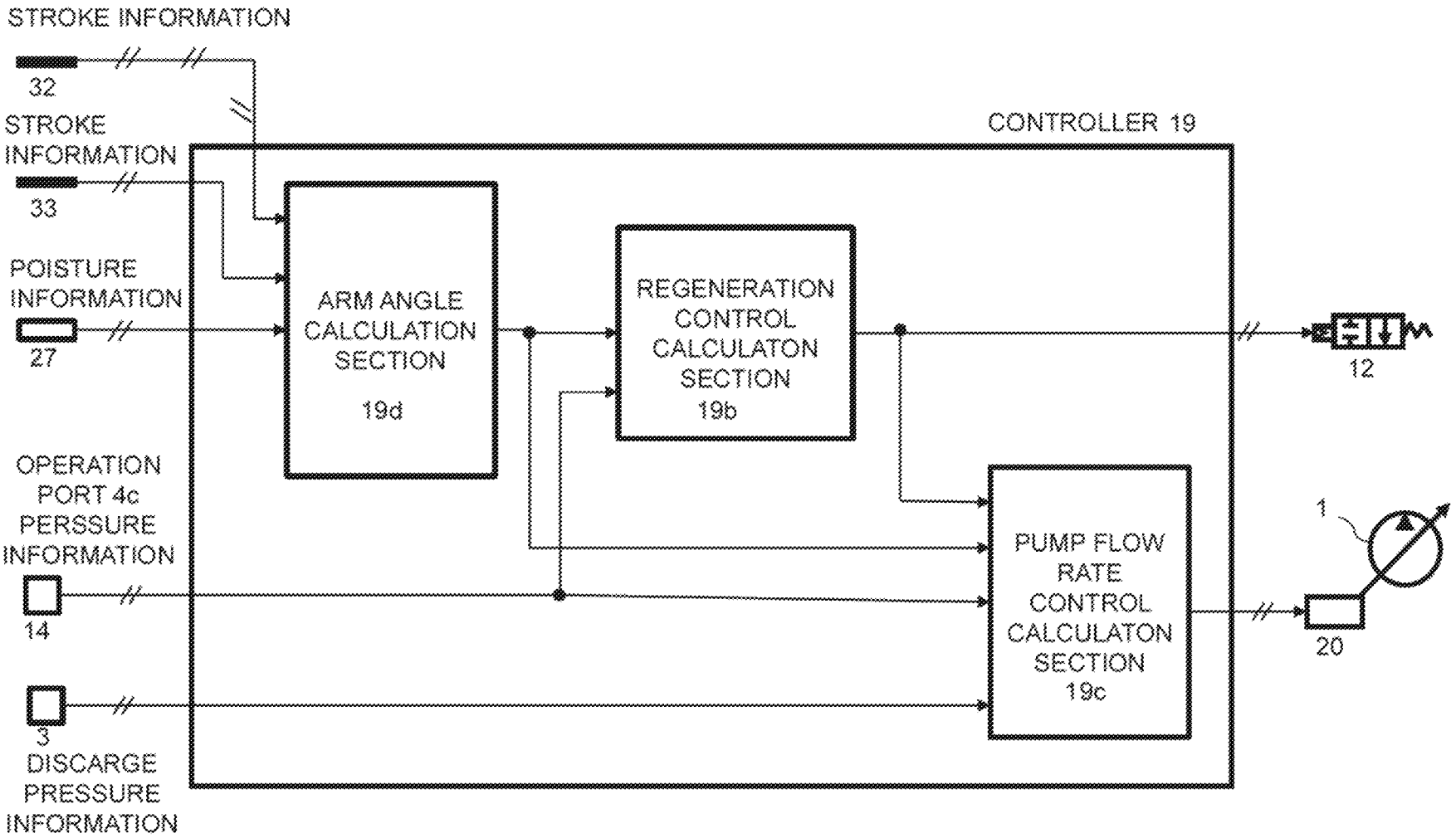
FIG. 20 is a functional block diagram illustrating contents of processing performed by a controller.

A hydraulic system of a work machine according to a fourth embodiment of the present invention is explained by using FIG. 19 and FIG. 20. Note that explanations of portions similar to the first embodiment are omitted.

First, the configuration of the fourth embodiment is explained by using FIG. 19. A difference from the first embodiment is that, as posture information acquiring devices, an angular velocity sensor 27 to measure the angular velocity of the machine body (the lower track structure 201 and upper swing structure 202) relative to the horizontal plane, a stroke sensor 32 for measuring the stroke length of the boom cylinder 34, and a stroke sensor 33 for measuring the stroke length of the arm cylinder 9 are attached, instead of the inertial measurement unit 31 attached to the arm 16. The angular velocity sensor 27, and stroke sensor 32 and 33 are each electrically connected with the controller 19.

Next, contents of processing performed by the controller 19 are explained by using FIG. 20. Differences from the first embodiment are that the controller 19 further includes an arm angle calculation section 19*d*, and that, instead of posture information from the inertial measurement unit 31, information from the angular velocity sensor 27, stroke sensor 32, and stroke sensor 33 is input, and the arm angle calculation section 19*d* uses the information to calculate posture information about the arm. The regeneration control calculation section 19*b*, and pump flow rate control calculation section 19*c* perform calculation similar to that in the first embodiment based on the posture information about the arm 16 output from the arm angle calculation section 19*d*.

Next, contents of calculation performed by the arm angle calculation section 19*d* are explained. The arm angle calculation section 19*d* determines in advance a relationship between an output value of the stroke sensor 32 and the angle θB illustrated in FIG. 18, and a relationship between an output value of the stroke sensor 33 and the angle θA illustrated in FIG. 18. Then, during operation, the angles θB and θA are determined from measurements of the stroke sensors 32 and 33, and the inclination θbody of the machine body illustrated in FIG. 18 is acquired from the angular velocity sensor 27. Then, the arm angle θArm relative to the horizontal plane is determined by using Formula (1) illustrated in FIG. 18.

Effects similar to those attained in the first embodiment can be attained according to the present embodiment also.

Fifth Embodiment

A hydraulic system of a work machine according to a fifth embodiment of the present invention is explained by using FIG. 21 to FIG. 24. Note that explanations of portions similar to the first embodiment are omitted.

Figure 21:
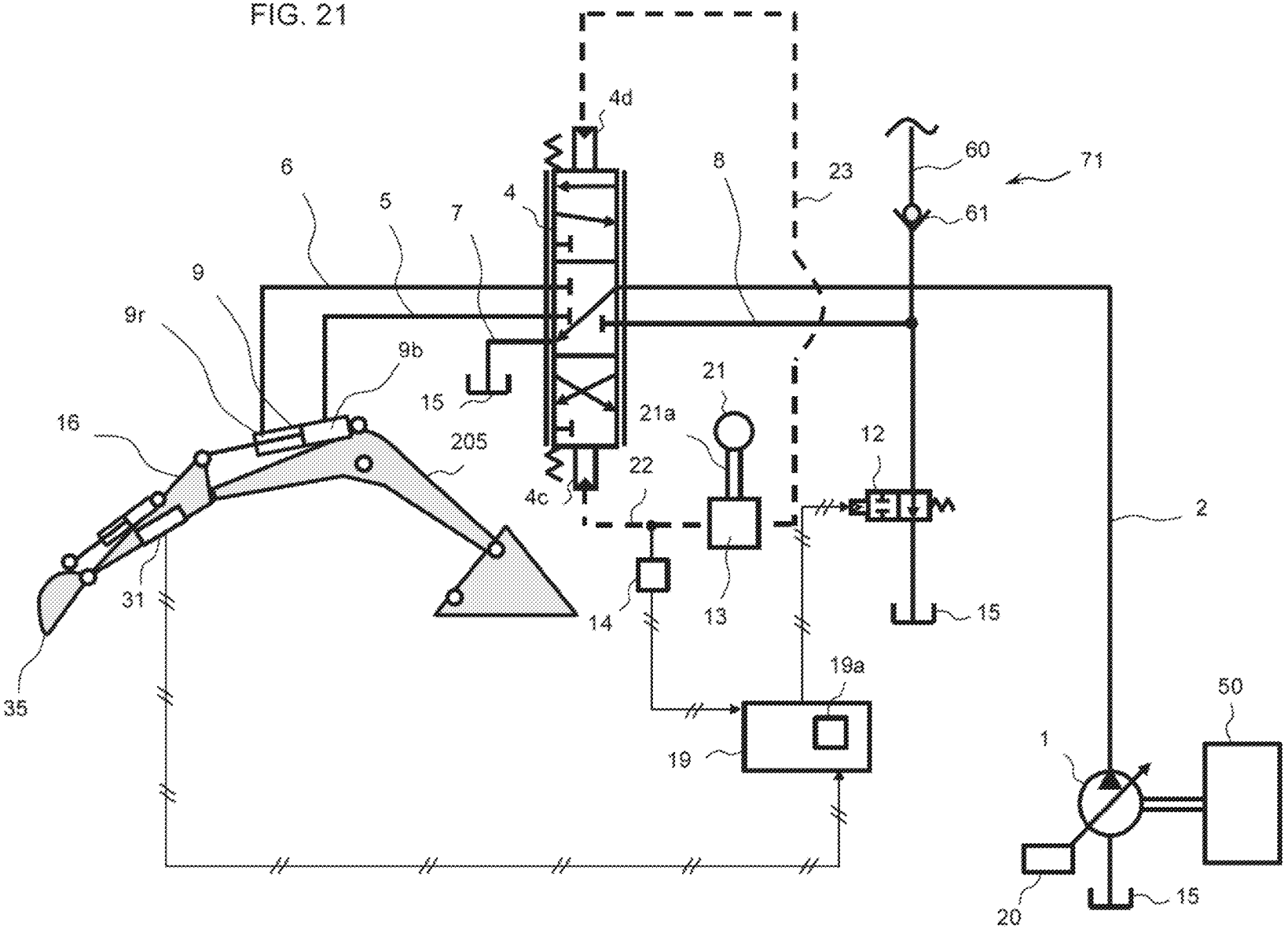
FIG. 21 is a figure illustrating a circuit portion related to an arm cylinder of a hydraulic system provided to a work machine, of a fifth embodiment of the present invention, the figure illustrating a case where there is no input to an operation lever.
Figure 22:
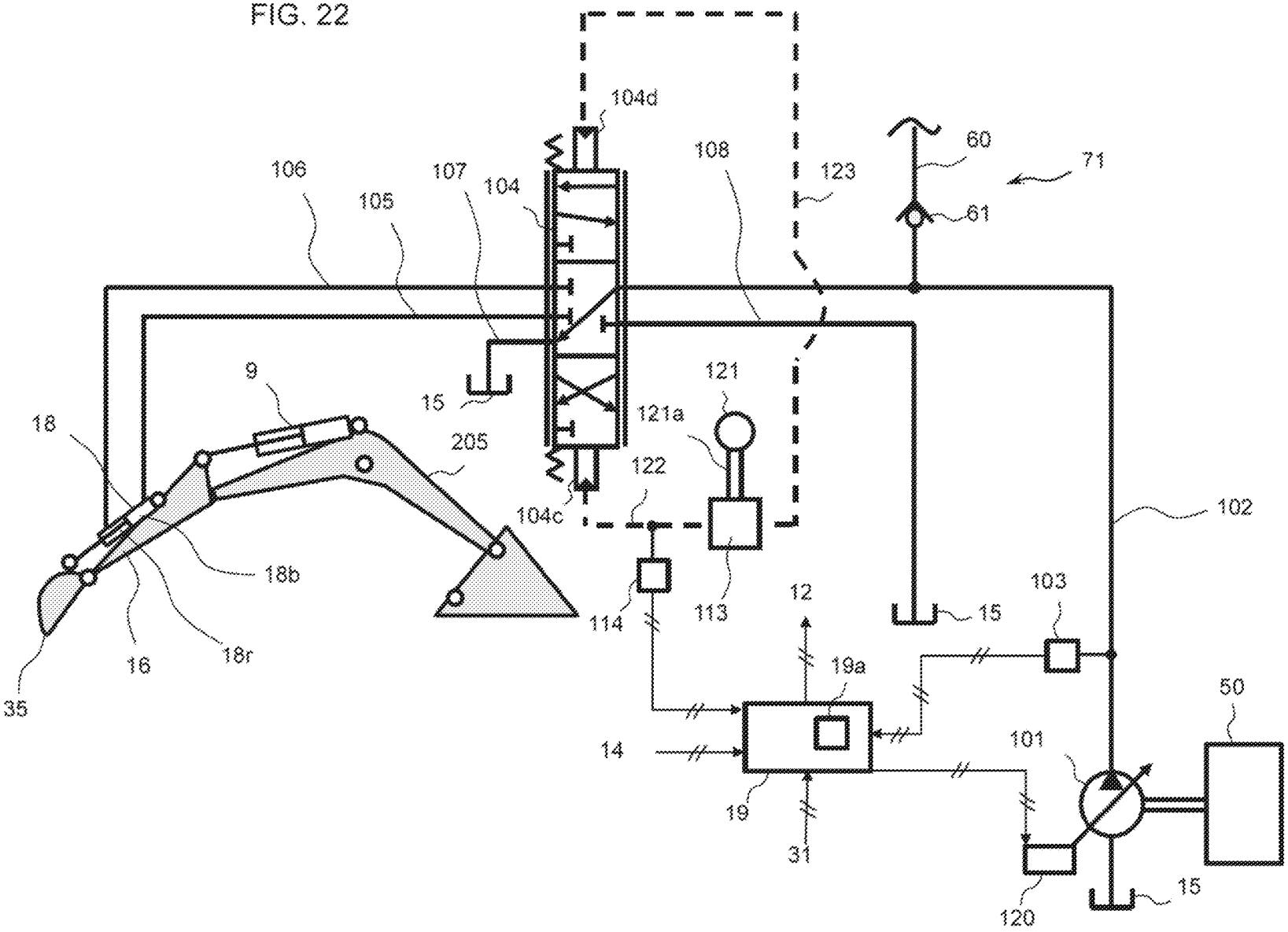
FIG. 22 is a figure illustrating a circuit portion related to a bucket cylinder of the hydraulic system provided to the work machine, of the fifth embodiment of the present invention, the figure illustrating a case where there is no input to the operation lever

First, the circuit configuration of the hydraulic system in the fifth embodiment is explained by using FIG. 21 and FIG. 22. FIG. 21 is a figure illustrating a circuit portion related to the arm cylinder 9 of the hydraulic system, and FIG. 22 is a figure illustrating a circuit portion related to the bucket cylinder 18 of the hydraulic system.

A difference of the present embodiment from the first embodiment is the installation position of a regenerating circuit 71.

That is, the hydraulic system in the present embodiment includes: a regeneration line 60 that is located upstream of the regeneration valve 12 illustrated in FIG. 21, and connects the tank line 8 to a hydraulic fluid supply line 102 of a hydraulic pump 101 illustrated in FIG. 22; and a check valve 61 that is arranged in the regeneration line 60, allows a flow of hydraulic fluid from the tank line 8 to the hydraulic fluid supply line 102, and prevents a flow of hydraulic fluid in the opposite direction, and the regeneration line 60 and check valve 61 constitute the regenerating circuit 71.

In addition, as illustrated in FIG. 22, the hydraulic system in the present embodiment includes: the variable displacement hydraulic pump 101 mentioned above driven by the engine 50; a pump flow rate regulation device 120 that controls the delivery flow rate of the hydraulic pump 101; a directional control valve 104 connected to the hydraulic fluid supply line 102 of the hydraulic pump 101; the bucket cylinder 18 that drives the bucket 35 illustrated in FIG. 29; a bottom line 105 that connects the directional control valve 104 to a bottom-side chamber 18*b* of the bucket cylinder 18; a rod line 106 that connects the directional control valve 104 to the rod-side chamber 18*r* of the bucket cylinder 18; a center bypass line 107 that connects the directional control valve 104 to the tank 15; and a tank line 108 that connects the directional control valve 104 to the tank 15.

In addition, the hydraulic system in the present embodiment includes an operation lever device 121 which is one of operation devices arranged in the cabin 202*b* illustrated in FIG. 29. The operation lever device 121 is constituted by an operation lever 121*a*, and a pilot valve 113 attached to a base end portion of the operation lever 121*a*. The pilot valve 113 is connected to an operation port 104*c* of the directional control valve 104 via a pilot line 122, which operation port 104*c* is for actuation in the bucket crowding direction, and to an operation port 104*d* via a pilot line 123, which operation port 104*d* is for actuation in the bucket dumping direction. A pressure corresponding to an operation amount of the operation lever 121*a* is guided from the pilot valve 113 to the operation port 104*c* or operation port 104*d* of the directional control valve 104.

A pressure sensor 103 for measuring the delivery pressure of the hydraulic pump 101, as a pressure information acquiring device to acquire the delivery pressure of the hydraulic pump 101, is attached to the hydraulic fluid supply line 102.

A pressure sensor 114 for detecting a pressure to be transmitted to the operation port 104*c*, as an actuation direction information acquiring device to acquire the bucket cylinder 18's direction and as an operation amount information acquiring device to acquire an operation amount of the operation lever device 121 with an operation by an operator, is attached to the pilot line 122.

Along with the pressure sensor 14 and inertial measurement unit 31 illustrated in FIG. 21, the pressure sensor 103 and pressure sensor 114 are electrically connected to the controller 19, and the controller 19 is electrically connected to the pump flow rate regulation device 120 and to the solenoid of the regeneration valve 12. The controller 19 has the CPU 19*a* in which a program is embedded, receives input of detection values of the pressure sensor 103, pressure sensors 14 and 114, and inertial measurement unit 31, performs predetermined calculation processing based on the program, and outputs a control signal for the pump flow rate regulation device 120 and the solenoid of the regeneration valve 12.

The regenerating circuit 71 constituted by the regeneration line 60, and check valve 61 supplies a hydraulic fluid discharged from the hydraulic fluid discharge-side (rod-side chamber 9*r*) of the arm cylinder 9, which is a first actuator, to the hydraulic fluid supply-side (bottom-side chamber 18*b*) of the bucket cylinder 18, which is a second actuator. That is, in the present embodiment, the second actuator is an actuator (the bucket cylinder 18) that is different from the first actuator, and drives the bucket 35 which is a second front part different from the arm 16 which is a first front part.

Figure 23:
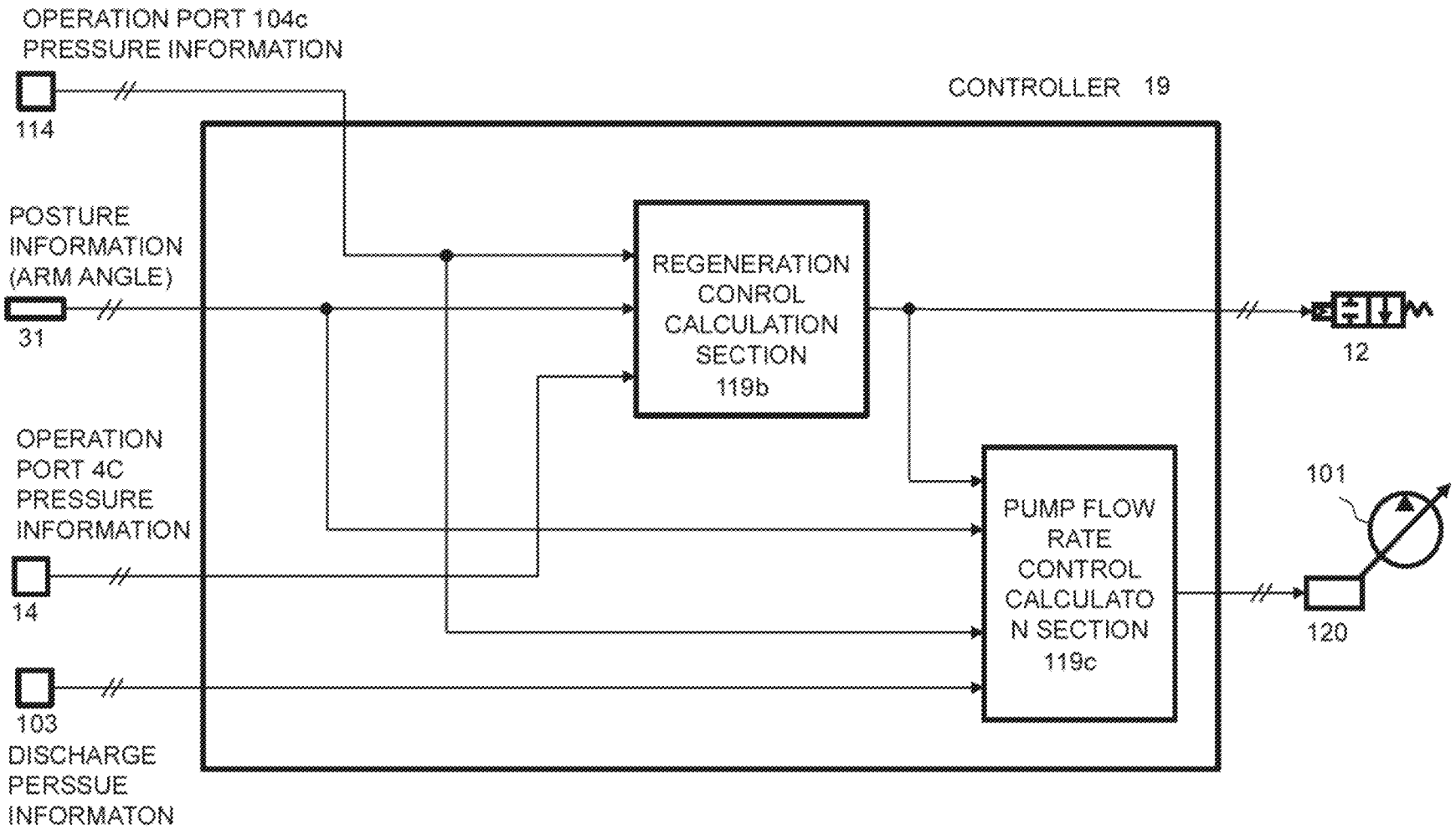
FIG. 23 is a functional block diagram illustrating contents of processing performed by a controller.

Next, contents of processing performed by the controller 19 are explained by using the functional block diagram of FIG. 23.

Differences from the controller 19 in the first embodiment are that the regeneration control calculation section 19*b* and pump flow rate control calculation section 19*c* are replaced by a regeneration control calculation section 119*b* and a pump flow rate control calculation section 119*c*, pressure information about the operation port 104*c* is additionally input to the regeneration control calculation section 119*b*, pressure information about the operation port 104*c* and delivery pressure information about the hydraulic pump 101 are input to the pump flow rate control calculation section 119*c*, instead of the pressure information about the operation port 4*c* and the delivery pressure information about the hydraulic pump 1.

Figure 24:
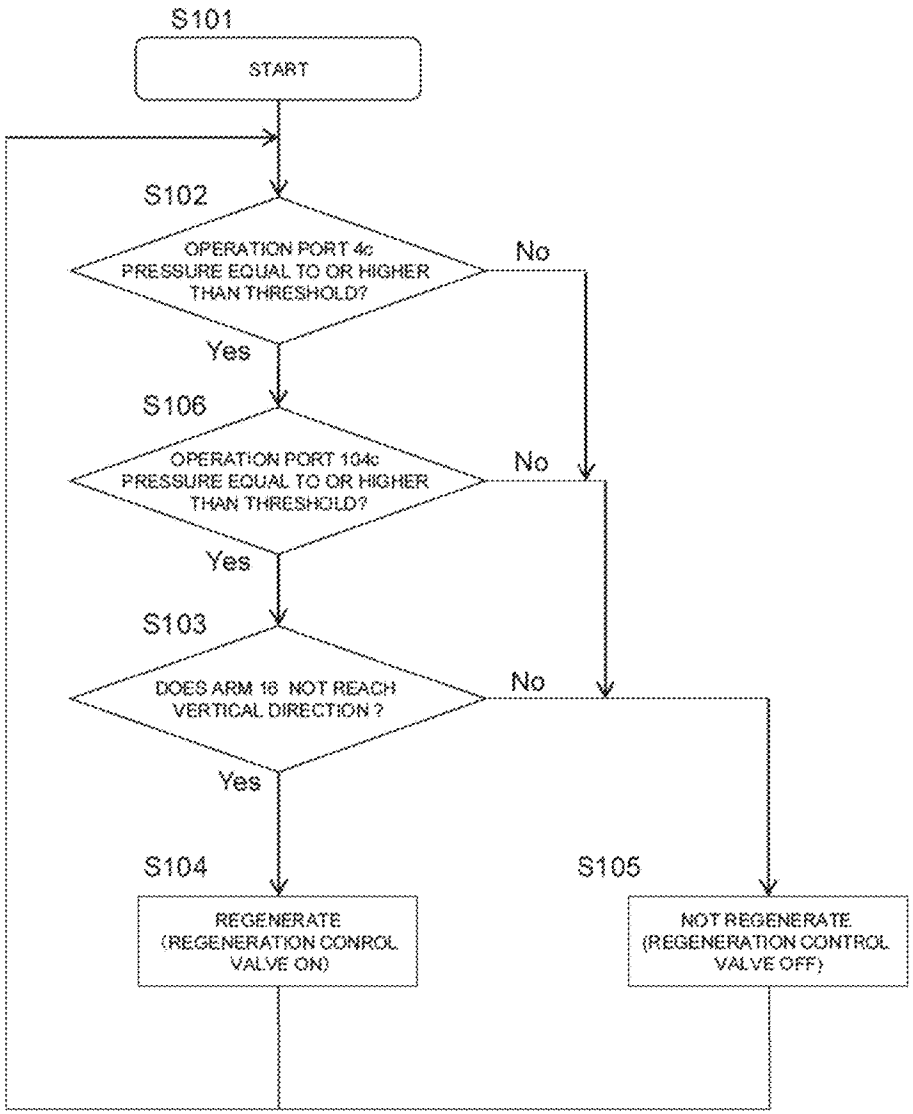
FIG. 24 is a flowchart illustrating a flow of processing performed by a regeneration control calculation section.

Next, contents of processing performed by the regeneration control calculation section 119*b* are explained by using FIG. 24. FIG. 24 illustrates a flow of processing performed by the regeneration control calculation section 119*b*. A difference from the flow of processing illustrated in FIG. 7 of the first embodiment is that, when the result of determination at Step S102 is Yes, the process continues on to processing at Step S106. At Step S106, it is determined whether the pressure of the operation port 104*c* is equal to or higher than a predetermined threshold. When the pressure of the operation port 104*c* is equal to or higher than the predetermined threshold, the result of determination at Step S106 is Yes, and the process continues on to processing at Step S103. When the pressure of the operation port 104*c* is lower than the predetermined threshold, the result of determination at Step S106 is No, and the process continues on to processing at Step S105. The predetermined threshold used at Step S106 is a value at which the meter-in opening of the directional control valve 104 is no longer 0, similar to the predetermined threshold used at Step S102.

Similar to the first embodiment, when the posture of the arm 16 does not reach the vertically downward direction, and the result of determination at Step S103 is Yes, the process continues on to processing at Step S104. At Step S104, the regeneration control calculation section 119*b* outputs a signal for exciting the solenoid of the regeneration valve 12. At Step S105, the regeneration control calculation section 119*b* outputs a signal for not exciting the solenoid of the regeneration valve 12.

With this process, regeneration is performed only when both the arm 16 and the bucket 35 are being operated.

Figure 25:
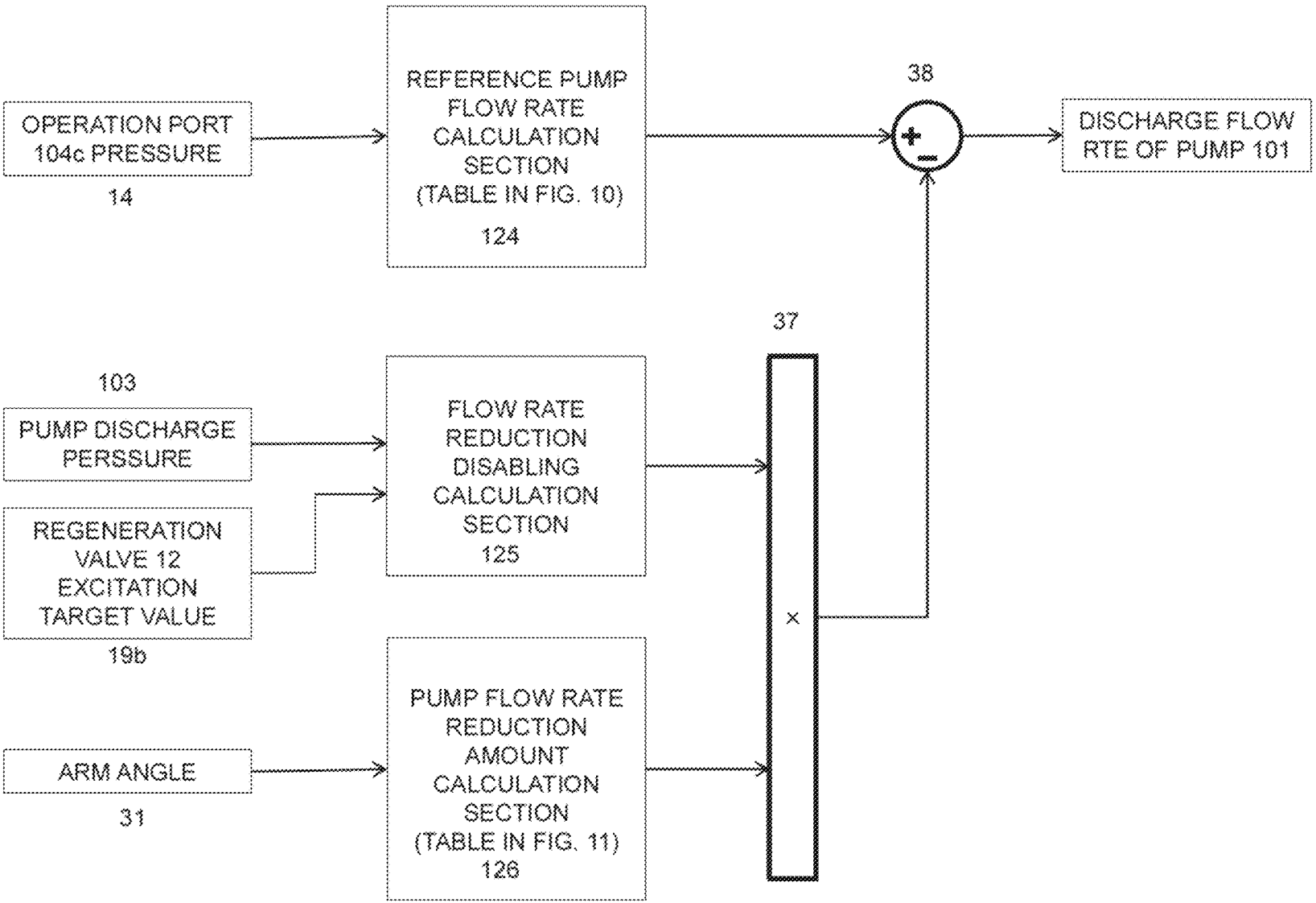
FIG. 25 is a functional block diagram illustrating contents of processing performed by a pump flow rate control calculation section.

Next, contents of processing performed by the pump flow rate control calculation section 119*c* are explained by using FIG. 25. FIG. 25 is a functional block diagram illustrating contents of processing performed by the pump flow rate control calculation section 119*c*. Differences of the processing performed by the pump flow rate control calculation section 119*c* from the processing illustrated in the functional block diagram illustrated in FIG. 9 of the first embodiment are that the reference pump flow rate calculation section 24, flow rate reduction disabling calculation section 25, and pump flow rate reduction amount calculation section 26 are respectively replaced by a reference pump flow rate calculation section 124, a flow rate reduction disabling calculation section 125, and a pump flow rate reduction amount calculation section 126, pressure information about the operation port 104*c* is input to the reference pump flow rate calculation section 124, and delivery pressure information about the hydraulic pump 101, and excitation target value information about the regeneration valve 12 are input to the flow rate reduction disabling calculation section 125.

The reference pump flow rate calculation section 124 receives input of the pressure of the operation port 104*c*, and calculates a reference pump flow rate of the hydraulic pump 101. The relationship between the pressure of the operation port 104*c* and the reference pump flow rate of the hydraulic pump 101 at this time is the same as that used by the reference pump flow rate calculation section 24 in the first embodiment illustrated in FIG. 10, and the reference pump flow rate is set to increase as the pressure of the operation port 104*c* rises.

The flow rate reduction disabling calculation section 125 receives input of the delivery pressure of the hydraulic pump 101, and the excitation target value for the regeneration valve 12 to perform flow rate reduction disabling calculation. The flow of processing performed by the flow rate reduction disabling calculation section 125 at this time is the same as the flow of processing performed by the flow rate reduction disabling calculation section 25 illustrated in FIG. 12 except that it is determined whether the delivery pressure of the hydraulic pump 101, instead of the delivery pressure of the hydraulic pump 1, is equal to or higher than a predetermined threshold at Step S203 in the flow of processing performed by the flow rate reduction disabling calculation section 25 illustrated in FIG. 12. The flow rate reduction disabling calculation section 125 outputs 1 or 0 according to the results of determination at Step S205 and Step S206 illustrated in FIG. 12

The pump flow rate reduction amount calculation section 126 receives input of an arm angle relative to the horizontal plane, and calculates a reduction amount of the delivery flow rate of the hydraulic pump 101. In this calculation method, similar to the pump flow rate reduction amount calculation section 26 in the first embodiment illustrated in FIG. 9, a relationship similar to the relationship between the arm angle and the pump flow rate reduction amount illustrated in FIG. 11 is used to calculate the reduction amount of the delivery flow rate of the hydraulic pump 101.

Thereafter, the multiplying section 37 multiplies output of the pump flow rate reduction amount calculation section 126 and output of the flow rate reduction disabling calculation 125, and the subtracting section 38 subtracts the product from an output value of reference pump flow rate calculation section 124, and calculates a finally used target value of the delivery flow rate of the hydraulic pump 101.

According to the present embodiment, when the angle of the arm angle is closer to the horizontal direction, the rate of flow delivered from the hydraulic pump 101 to be supplied to the bucket cylinder 18 is reduced, and as the angle of the arm 16 approaches the vertical direction, the rate of flow delivered from the hydraulic pump 101 to be supplied to the bucket cylinder 18 is increased. Thereby, speed reduction of the arm 16 can be reduced, and the operability can be maintained while at the same time output of the hydraulic pump 101 is reduced to enhance fuel efficiency.

Sixth Embodiment

Figure 26:
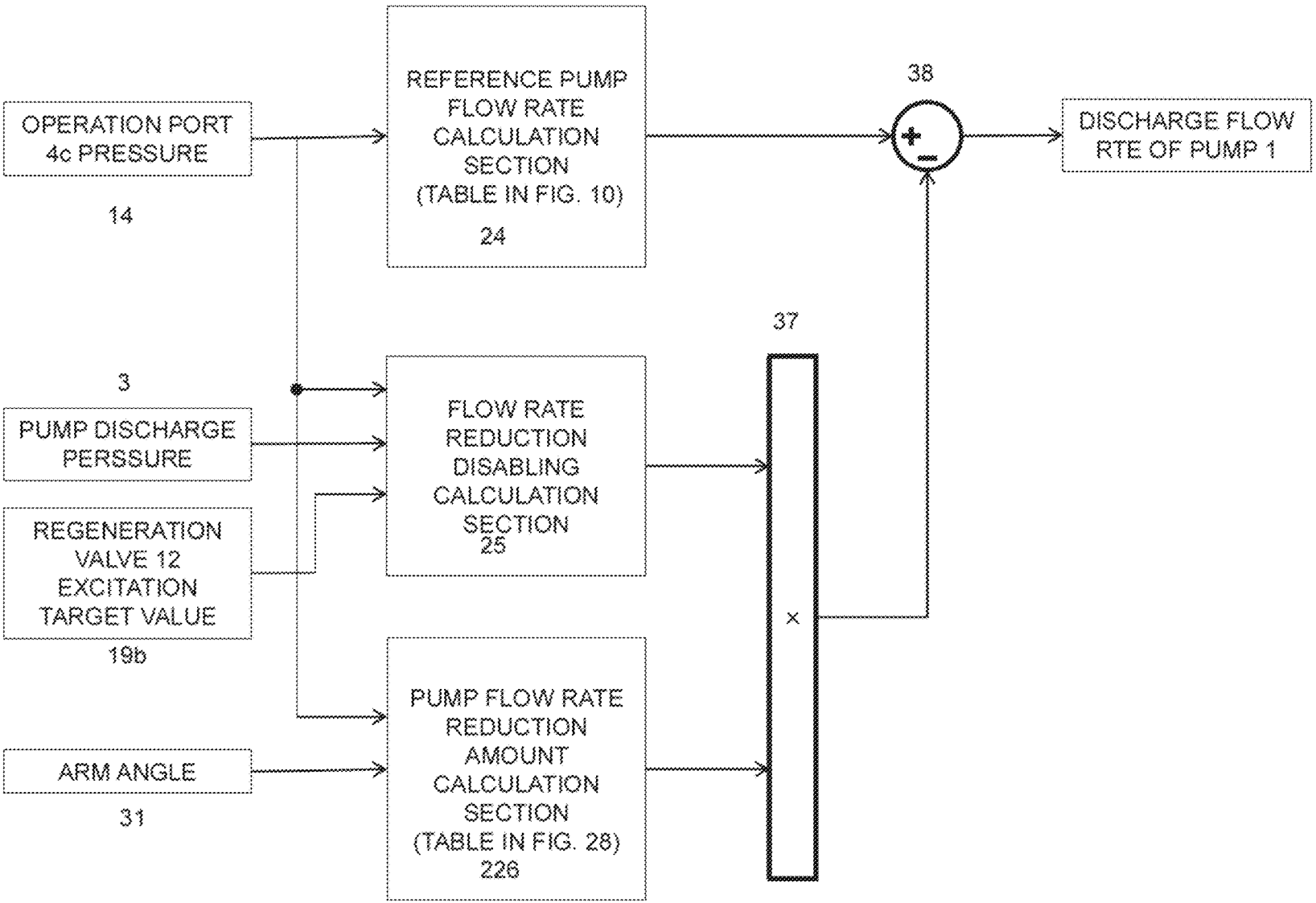
FIG. 26 is a functional block diagram illustrating contents of processing performed by the pump flow rate control calculation section of a controller in a hydraulic system provided to a work machine, of a sixth embodiment of the present invention.
Figure 27:
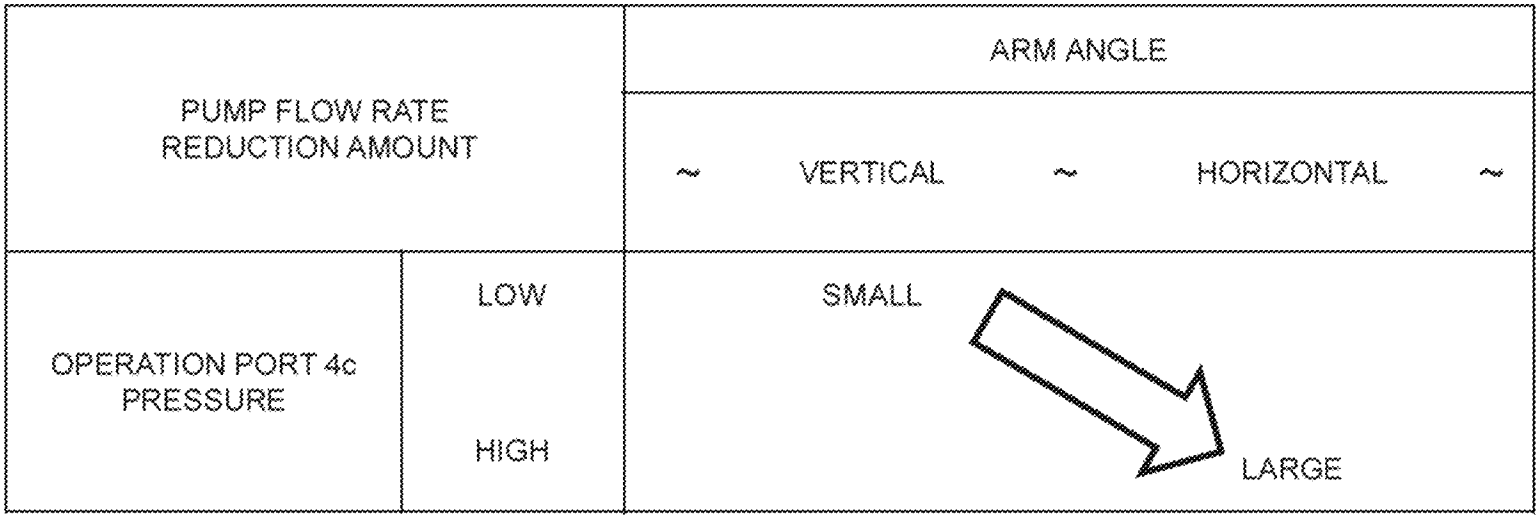
FIG. 27 is a conceptual figure illustrating a way of thinking about processing performed by the pump flow rate reduction amount calculation section.
Figure 28:
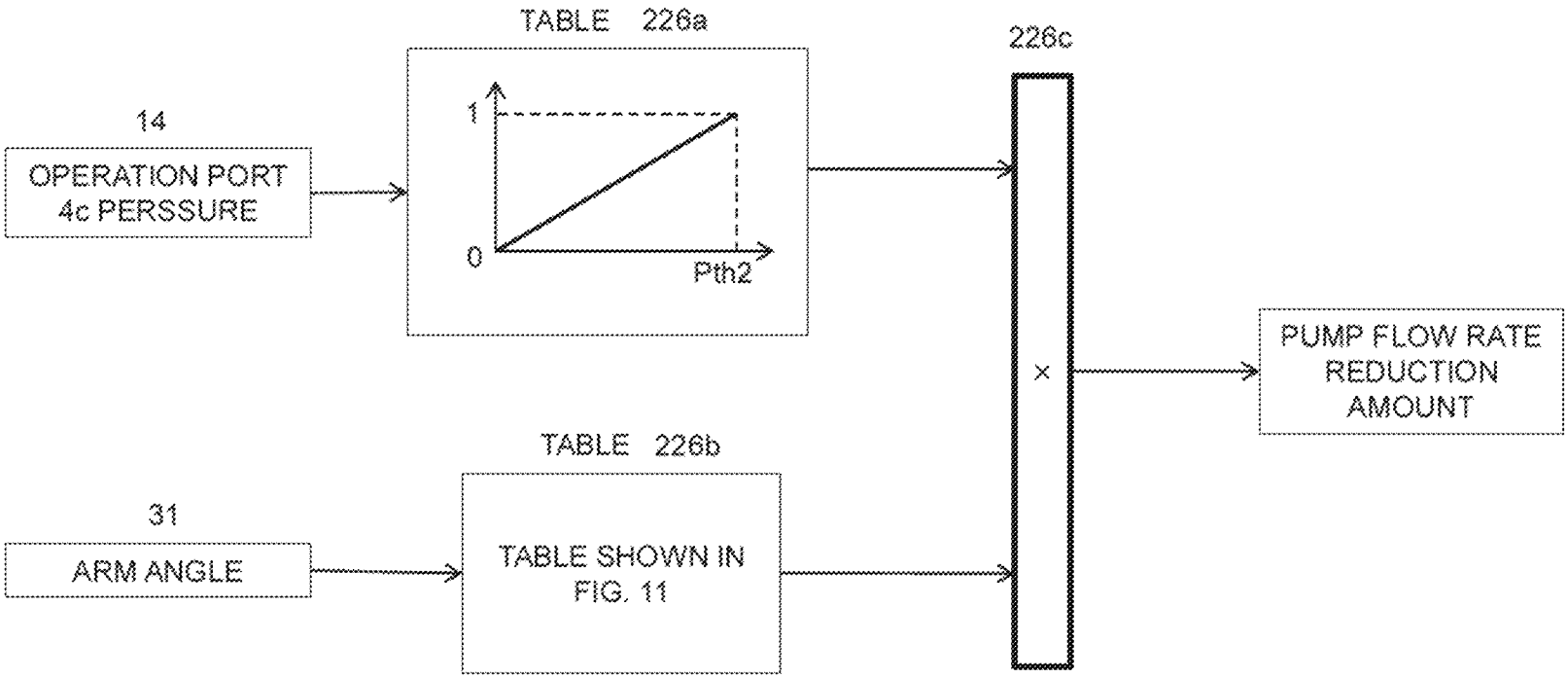
FIG. 28 is a functional block diagram illustrating contents of processing performed by the pump flow rate reduction amount calculation section.

A hydraulic system of a work machine according to a sixth embodiment of the present invention is explained by using FIG. 26, FIG. 27, and FIG. 28. Note that explanations of portions similar to the first embodiment are omitted.

A difference of the present embodiment from the first embodiment is processing performed by the pump flow rate control calculation section 19*c* in functions of the controller 19 in the first embodiment illustrated in the functional block diagram of FIG. 6.

Contents of processing performed by the pump flow rate control calculation section 19*c* in the present embodiment are explained by using FIG. 26, FIG. 27, and FIG. 28.

FIG. 26 is a functional block diagram illustrating contents of processing performed by the pump flow rate control calculation section 19*c*. A difference from the first embodiment is that the pump flow rate reduction amount calculation section 226 receives input of pressure information about the operation port 4*c*.

FIG. 27 illustrates a way of thinking about processing performed by the pump flow rate reduction amount calculation section 226 illustrated in FIG. 26. As the angle of the arm 16 is closer to the horizontal direction, the reduction amount of the delivery flow rate of the hydraulic pump 1 is increased, and as the angle of the arm 16 approaches the vertical direction, the reduction amount of the delivery flow rate of the hydraulic pump 1 is reduced. In addition, as the pressure of the operation port 4*c* lowers, the reduction amount of the delivery flow rate of the hydraulic pump 1 is reduced, and as the pressure of the operation port 4*c* rises, the reduction amount of the delivery flow rate of the hydraulic pump 1 is increased.

Next, specific contents of processing performed by the pump flow rate reduction amount calculation section 226 are explained by using FIG. 28.

In FIG. 28, the pressure of the operation port 4*c* is input to a table 226*a*. According to a relationship between the pressure and output of the operation port 4*c* set in this table 226*a*: when the pressure of the operation port 4*c* is 0 [MPa], 0 is output; when the pressure of the operation port 4*c* is a predetermined value Pth2 [MPa], 1 is output; as the pressure of the operation port 4*c* increases from 0 [MPa] to the predetermined value Pth2 [MPa], the output increases from 0 to 1. The predetermined value Pth2 [MPa] is the maximum value of the pressure of the operation port 4*c*.

The angle of the arm 16 is input to a table 226*b* for which the same relationship between the arm angle and a pump flow rate reduction amount as that illustrated in FIG. 11 is set, and a reduction amount of the delivery flow rate of the hydraulic pump 1 is calculated.

Last, the two values explained above are multiplied at the multiplying section 226*c*, a reduction amount of the delivery flow rate of the hydraulic pump 1 reflecting the way of thinking illustrated in FIG. 27 is calculated.

By doing so, the delivery flow rate of the hydraulic pump 1 is reduced and the output power of the hydraulic pump 1 is reduced when the direction of the arm 16 is closer to the horizontal direction and the amount of hydraulic fluid flowing through the regeneration line 10 is large, thereby enhancing fuel efficiency. In addition, the speed of the arm cylinder 9 (the speed of the arm 16) no longer easily lowers because the delivery flow rate of the hydraulic pump 1 is sufficiently high even when the arm 16 has reached the vertical direction, the regeneration valve 12 entered the non-excited state, and the amount of hydraulic fluid flowing through the regeneration line 10 has become small. Furthermore, when the reference pump flow rate of the hydraulic pump 1 calculated by the reference pump flow rate calculation section 24 is low since the pressure of the operation port 4*c* is low, it is possible to prevent the speed of the arm cylinder 9 (the speed of the arm 16) from becoming too low due to an excessively large reduction amount of the delivery flow rate of the hydraulic pump 1.

OTHER NOTES

Although in the embodiments explained above, the work machine is a hydraulic excavator including a front work implement, an upper swing structure, and a lower track structure, the present invention can be similarly applied to work machines other than hydraulic excavators such as wheel loaders, hydraulic cranes, or telehandlers as long as they are work machines including hydraulic cylinders to move front work implements up and down, and similar effects can be attained in that case also.

DESCRIPTION OF REFERENCE CHARACTERS

1, 101: Hydraulic pump
2, 102: Hydraulic fluid supply line
3, 103: Pressure sensor (pressure information acquiring device)
4, 104: Directional control valve
5, 105: Bottom line
6, 106: Rod line
7, 107: Center bypass line
8, 108: Tank line
9: Arm cylinder (serving as both a first actuator and a second actuator)
10, 60: Regeneration line
11, 61: Check valve
12: Regeneration valve (regeneration control device)
13, 113: Pilot valve
14, 114: Pressure sensor (actuation direction information acquiring device; operation amount information acquiring device)
15: Tank
16: Arm (first front part)
18: Bucket cylinder (second actuator)
19: Controller
19*a*: CPU
19*b*, 119*b*: Regeneration control calculation section
19*c*, 119*c*: Pump flow rate control calculation section
20, 120: Pump flow rate regulation device
21, 121: Operation lever device (operation device)
21*a*, 121*a*: Operation lever
22, 122: Pilot line
23, 123: Pilot line
24: Reference pump flow rate calculation section
25: Flow rate reduction disabling calculation section
26: Pump flow rate reduction amount calculation section
27: Angular velocity sensor
28, 29: Angle sensor
30: Pressure sensor (pressure information acquiring device)
31: Inertial measurement unit (IMU) (posture information acquiring device)
32, 33: Stroke sensor
34: Boom cylinder
35: Bucket (second front part)
41, 71: Regenerating circuit
203: Front work implement

The invention claimed is:

1. A work machine comprising:

a front work implement constituted by a plurality of front parts, each of the plurality of front parts being pivotably connected with a machine body or other front parts; and a hydraulic system including a plurality of actuators that drive the plurality of front parts, the plurality of front parts including a first front part that can move in a vertically downward direction with a free fall thereof, the plurality of actuators including a first actuator that is a hydraulic cylinder type that drives the first front part, the hydraulic system including:

a regenerating circuit that supplies a hydraulic fluid discharged from a hydraulic fluid discharge-side of the first actuator to a hydraulic fluid supply-side of the first actuator;

a regeneration control device that controls a regenerating state of the regenerating circuit;

a hydraulic pump that supplies hydraulic fluid to the first actuator; and a pump flow rate regulation device that controls a delivery flow rate of the hydraulic pump, wherein the work machine further comprises:

a posture information acquiring device that acquires posture information about the first front part; and a controller that controls the regeneration control device and the pump flow rate regulation device on a basis of the posture information about the first front part acquired by the posture information acquiring device, and the controller includes:

a regeneration control calculation section that controls the regeneration control device to cause the regenerating circuit to perform regeneration based on the posture information about the first front part acquired by the posture information acquiring device when the first front part moves in the vertically downward direction with the free fall thereof; and a pump flow rate control calculation section that controls the pump flow rate regulation device to increase the delivery flow rate of the hydraulic pump successively as a direction of the first front part approaches the vertically downward direction, based on the posture information about the first front part acquired by the posture information acquiring device, when the regeneration control calculation section controls the regeneration control device to perform regeneration.

2. The work machine according to claim 1, wherein the hydraulic system further includes a pressure information acquiring device that acquires one of a pressure on a hydraulic fluid inflow-side of the first actuator and a delivery pressure of the hydraulic pump, and the pump flow rate control calculation section controls the pump flow rate regulation device to increase the delivery pressure of the hydraulic pump by increasing the delivery flow rate of the hydraulic pump when one of the pressure on the hydraulic fluid inflow-side of the first actuator and the delivery pressure of the hydraulic pump acquired by the pressure information acquiring device is lower than a predetermined threshold even when the direction of the first front part does not approach the vertically downward direction.

3. The work machine according to claim 1, wherein the hydraulic system further includes an actuation direction information acquiring device that acquires an actuation direction of the first actuator, and the regeneration control calculation section decides whether or not the first front part moves in the vertically downward direction with free fall thereof based on the actuation direction of the first actuator acquired by the actuation direction information acquiring device and the posture information about the first front part acquired by the posture information acquiring device.

4. The work machine according to claim 1, wherein the hydraulic system further includes:

an operation device that is operated by an operator and generates a command for operation of the first actuator; and an operation amount information acquiring device that acquires an operation amount of the operation device with operation by the operator, and the pump flow rate control calculation section controls, based on the posture information about the first front part acquired by the posture information acquiring device, the pump flow rate regulation device to increase the delivery flow rate of the hydraulic pump as the direction of the first front part approaches the vertically downward direction, while controlling the pump flow rate regulation device to reduce an increase amount of the delivery flow rate of the hydraulic pump as the operation amount acquired by the operation amount information acquiring device decreases.

5. The work machine according to claim 1, wherein the hydraulic system further includes:

an operation device that is operated by an operator and generates a command for operation of the first actuator;

an operation amount information acquiring device that acquires an operation amount of the operation device with an operation by the operator; and a pressure information acquiring device that acquires one of a pressure on a hydraulic fluid inflow-side of the first actuator and a delivery pressure of the hydraulic pump, the pump flow rate control calculation section is configured to:

calculate a reference flow rate of the hydraulic pump based on the operation amount of the operation device acquired by the operation amount information acquiring device; and perform control such that the delivery flow rate of the hydraulic pump increases as the direction of the first front part approaches the vertically downward direction by calculating a reduction amount of the delivery flow rate of the hydraulic pump that is largest when the direction of the first front part is horizontal and decreases as the direction of the first front part approaches the vertically downward direction, and by subtracting the reduction amount of the delivery flow rate of the hydraulic pump from the reference flow rate of the hydraulic pump, and the pump flow rate control calculation section is further configured to calculate 0 as the reduction amount of the delivery flow rate of the hydraulic pump when one of the pressure on the hydraulic fluid inflow-side of the first actuator and the delivery pressure of the hydraulic pump acquired by the pressure information acquiring device is lower than a predetermined threshold.

6. The work machine according to claim 5, wherein the pump flow rate reduction amount calculation section controls the pump flow rate regulation device to increase the reduction amount of the delivery flow rate of the hydraulic pump and reduce an increase amount of the delivery flow rate of the hydraulic pump as the operation amount acquired by the operation amount information acquiring device decreases, when the pump flow rate reduction amount calculation section controls the pump flow rate regulation device to increase the delivery flow rate of the hydraulic pump by reducing the reduction amount of the delivery flow rate of the hydraulic pump as the direction of the first front part approaches the vertically downward direction, based on the posture information about the first front part acquired by the posture information acquiring device.

7. The work machine according to claim 1, wherein the first front part is an arm of a hydraulic excavator, and the first actuator is an arm cylinder that drives the arm.

8. The work machine according to claim 1, wherein the first front part is an arm of a hydraulic excavator, the second front part is a bucket of the hydraulic excavator, the first actuator is an arm cylinder that drives the arm, and the second actuator is a bucket cylinder that drives the bucket.

9. A work machine comprising:

a front work implement constituted by a plurality of front parts, each of the plurality of front parts being pivotably connected with a machine body or other front parts; and a hydraulic system including a plurality of actuators that drive the plurality of front parts, the plurality of front parts including a first front part that can move in a vertically downward direction with a free fall thereof, and a second front part that is connected to the first front part so as to be pivotable upward and downward, the plurality of actuators including a first actuator that is a hydraulic cylinder type that drives the first front part, and a second actuator that drives the second front part, the hydraulic system including:

a regenerating circuit that supplies a hydraulic fluid discharged from a hydraulic fluid discharge-side of the first actuator to a hydraulic fluid supply-side of the second actuator;

a regeneration control device that controls a regenerating state of the regenerating circuit;

a hydraulic pump that supplies hydraulic fluid to the second actuator; and a pump flow rate regulation device that controls a delivery flow rate of the hydraulic pump, wherein the work machine further comprises:

a posture information acquiring device that acquires posture information about the first front part; and a controller that controls the regeneration control device and the pump flow rate regulation device on a basis of the posture information about the first front part acquired by the posture information acquiring device, and the controller includes:

a regeneration control calculation section that controls the regeneration control device to cause the regenerating circuit to perform regeneration based on the posture information about the first front part acquired by the posture information acquiring device when the first front part moves in the vertically downward direction with the free fall thereof; and a pump flow rate control calculation section that controls the pump flow rate regulation device to increase the delivery flow rate of the hydraulic pump successively as a direction of the first front part approaches the vertically downward direction, based on the posture information about the first front part acquired by the posture information acquiring device, when the regeneration control calculation section controls the regeneration control device to perform regeneration.

10. The work machine according to claim 9, wherein the hydraulic system further includes a pressure information acquiring device that acquires one of a pressure on a hydraulic fluid inflow-side of the first actuator and a delivery pressure of the hydraulic pump, and the pump flow rate control calculation section controls the pump flow rate regulation device to increase the delivery pressure of the hydraulic pump by increasing the delivery flow rate of the hydraulic pump when one of the pressure on the hydraulic fluid inflow-side of the first actuator and the delivery pressure of the hydraulic pump acquired by the pressure information acquiring device is lower than a predetermined threshold even when the direction of the first front part does not approach the vertically downward direction.

11. The work machine according to claim 9, wherein the hydraulic system further includes an actuation direction information acquiring device that acquires an actuation direction of the first actuator, and the regeneration control calculation section decides whether or not the first front part moves in the vertically downward direction with the free fall thereof based on the actuation direction of the first actuator acquired by the actuation direction information acquiring device and the posture information about the first front part acquired by the posture information acquiring device.

12. The work machine according to claim 9 wherein the hydraulic system further includes:

an operation device that is operated by an operator and generates a command for operation of the second actuator; and an operation amount information acquiring device that acquires an operation amount of the operation device with operation by the operator, and the pump flow rate control calculation section controls, based on the posture information about the first front part acquired by the posture information acquiring device, the pump flow rate regulation device to increase the delivery flow rate of the hydraulic pump as the direction of the first front part approaches the vertically downward direction, while controlling the pump flow rate regulation device to reduce an increase amount of the delivery flow rate of the hydraulic pump as the operation amount acquired by the operation amount information acquiring device decreases.

13. The work machine according to claim 9, wherein the hydraulic system further includes:

an operation device that is operated by an operator and generates a command for operation of the second actuator;

an operation amount information acquiring device that acquires an operation amount of the operation device with an operation by the operator; and a pressure information acquiring device that acquires one of a pressure on a hydraulic fluid inflow-side of the first actuator and a delivery pressure of the hydraulic pump, the pump flow rate control calculation section is configured to:

calculate a reference flow rate of the hydraulic pump based on the operation amount of the operation device acquired by the operation amount information acquiring device; and perform control such that the delivery flow rate of the hydraulic pump increases as the direction of the first front part approaches the vertically downward direction by calculating a reduction amount of the delivery flow rate of the hydraulic pump that is largest when the direction of the first front part is horizontal and decreases as the direction of the first front part approaches the vertically downward direction, and by subtracting the reduction amount of the delivery flow rate of the hydraulic pump from the reference flow rate of the hydraulic pump, and the pump flow rate control calculation section is further configured to calculate 0 as the reduction amount of the delivery flow rate of the hydraulic pump when one of the pressure on the hydraulic fluid inflow-side of the first actuator and the delivery pressure of the hydraulic pump acquired by the pressure information acquiring device is lower than a predetermined threshold.

14. The work machine according to claim 13, wherein the pump flow rate reduction amount calculation section controls the pump flow rate regulation device to increase the reduction amount of the delivery flow rate of the hydraulic pump and reduce an increase amount of the delivery flow rate of the hydraulic pump as the operation amount acquired by the operation amount information acquiring device decreases, when the pump flow rate reduction amount calculation section controls the pump flow rate regulation device to increase the delivery flow rate of the hydraulic pump by reducing the reduction amount of the delivery flow rate of the hydraulic pump as the direction of the first front part approaches the vertically downward direction, based on the posture information about the first front part acquired by the posture information acquiring device.

* * * * *